US009921027B2

(12) United States Patent
Bruhns

(10) Patent No.: US 9,921,027 B2
(45) **Date of Patent: *Mar. 20, 2018**

(54) FIREARM HANDGRIP ASSEMBLY WITH LASER GUNSIGHT SYSTEM

(71) Applicant: Hogue, Inc., Henderson, NV (US)

(72) Inventor: James David Bruhns, Templeton, CA (US)

(73) Assignee: HOGUE, INC., Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/982,075

(22) Filed: Dec. 29, 2015

(65) Prior Publication Data

US 2017/0184373 A1 Jun. 29, 2017

(51) Int. Cl.
*F41C 23/10* (2006.01)
*F41C 3/14* (2006.01)
*F41G 1/35* (2006.01)

(52) U.S. Cl.
CPC ..... *F41C 23/10* (2013.01); *F41C 3/14* (2013.01); *F41G 1/35* (2013.01)

(58) Field of Classification Search
CPC ..... F41G 1/35; F41C 3/14; F41C 23/10
USPC ..... 42/71.02, 114, 117, 146; 362/114
See application file for complete search history.

(56) References Cited

U.S. PATENT DOCUMENTS 958,332 A 5/1910 Snyder
1,263,667 A 4/1918 Henderson et al.
2,450,584 A 10/1948 Dodge
4,199,887 A 4/1980 Hogue
5,056,254 A 10/1991 Bechtel
5,194,007 A 3/1993 Marshall et al.
5,282,594 A 2/1994 Huang
5,430,967 A 7/1995 Woodman et al.
5,435,091 A 7/1995 Toole et al.
5,485,695 A 1/1996 Glock
5,560,703 A 10/1996 Capps, III
5,581,898 A 12/1996 Thummel
(Continued)

FOREIGN PATENT DOCUMENTS

EP 00100985.1 3/2000

OTHER PUBLICATIONS

Crimson Trace, LG-401 for 1911 Full-Size Government/Commander Installation Handbook Lasergrips(R), Published Oct. 2010.
(Continued)

*Primary Examiner* — Bret Hayes
(74) *Attorney, Agent, or Firm* — Bennet K. Langlotz; Langlotz Patent & Trademark Works, Inc.

(57) ABSTRACT

A firearm handgrip assembly with laser gunsight system has a first grip frame element adapted for mounting to a first portion of the firearm frame, the first grip frame element including at least one of an illuminator, a battery, a switch, and a controller, a cover portion of the grip defining an interior channel adapted to closely receive at least a major portion of the first portion of the firearm frame and the first grip frame element, the cover portion having a contoured exterior surface adapted for gripping by a user's hand, and a fastener operably engaging the cover portion to the firearm frame. The firearm frame may be a curved butt frame of a revolver. The interior channel of the cover portion may be curved. The fastener may include a threaded element connected to a lower end of the firearm frame.

27 Claims, 21 Drawing Sheets

(56) References Cited

U.S. PATENT DOCUMENTS

| | | | |
|---|---|---|---|
| 5,590,486 | A | 1/1997 | Moore |
| 5,621,999 | A | 4/1997 | Moore |
| 5,654,594 | A | 8/1997 | Bjomsen et al. |
| 5,706,600 | A | 1/1998 | Toole et al. |
| 5,758,448 | A | 6/1998 | Thummel |
| 5,784,823 | A | 7/1998 | Chen |
| 6,185,854 | B1 | 2/2001 | Solinsky et al. |
| 6,230,431 | B1 | 5/2001 | Bear |
| 6,276,088 | B1 | 8/2001 | Matthews et al. |
| 6,378,237 | B1 | 4/2002 | Matthews et al. |
| 6,393,752 | B1 | 5/2002 | Oliver et al. |
| 6,578,311 | B2 | 1/2003 | Danielson et al. |
| 6,538,888 | B1 | 3/2003 | Wei et al. |
| 6,571,503 | B2 | 6/2003 | Thorpe |
| 6,574,901 | B1 | 6/2003 | Solinsky et al. |
| D487,791 | S | 3/2004 | Freed |
| 6,854,205 | B2 | 2/2005 | Wikle et al. |
| 7,117,627 | B2 | 10/2006 | Woodmansee, III et al. |
| D542,446 | S | 5/2007 | DiCarlo et al. |
| 7,260,910 | B2 | 8/2007 | Danielson |
| 7,275,344 | B2 | 10/2007 | Woodmansee, III et al. |
| D567,894 | S | 4/2008 | Sterling et al. |
| 7,395,627 | B2 | 7/2008 | La France et al. |
| 7,523,583 | B2 | 4/2009 | Cheng |
| D603,478 | S | 11/2009 | Hughes et al. |
| 7,805,876 | B1 | 10/2010 | Danielson et al. |
| 8,256,154 | B2 | 9/2012 | Danielson et al. |
| 9,243,865 | B1 * | 1/2016 | Bruhns ..... F41C 23/10 |
| 9,453,702 | B2 * | 9/2016 | Bruhns ..... F41C 23/10 |
| 2003/0196366 | A1 | 10/2003 | Beretta |
| 2010/0162610 | A1 * | 7/2010 | Moore ..... F41G 1/35 42/115 |
| 2013/0125441 | A1 * | 5/2013 | Westwood ..... F41A 17/02 42/70.05 |
| 2013/0185982 | A1 * | 7/2013 | Hilbourne ..... F41G 1/35 42/117 |

OTHER PUBLICATIONS

Armalaser Inc., http://www.armalaser.com/Kel_Tec_P32_P3AT-KEL_TEC_P32_P3AT.html, Accessed Sep. 12, 2008.

Ontargetsportsonline.com, The "Pocket Slipper Laser Aimer," http://www.ontargetsportsonline.com/images/LaserSights/PS_Info-Opt.jpg, Accessed Sep. 12, 2008.

Laserlyte, Pocket Pistol Laser for Ruger LCP, http://www.laserlyte.com/download/graphics/PL-1.html, Accessed Aug. 3, 2009.

Laserlyte, Mighty Mouse(tm) Laser, http://www.laserlyte.com/products/mightymouselaser, Accessed Mar. 31, 2015.

Smith&Wesson, Small Frame (J), http://www.smith-wesson.com/webapp/wcs/stores/servlet/Catergory4_750001_750051_757768_-1_757767_757751_image, accessed Nov. 12, 2015.

* cited by examiner

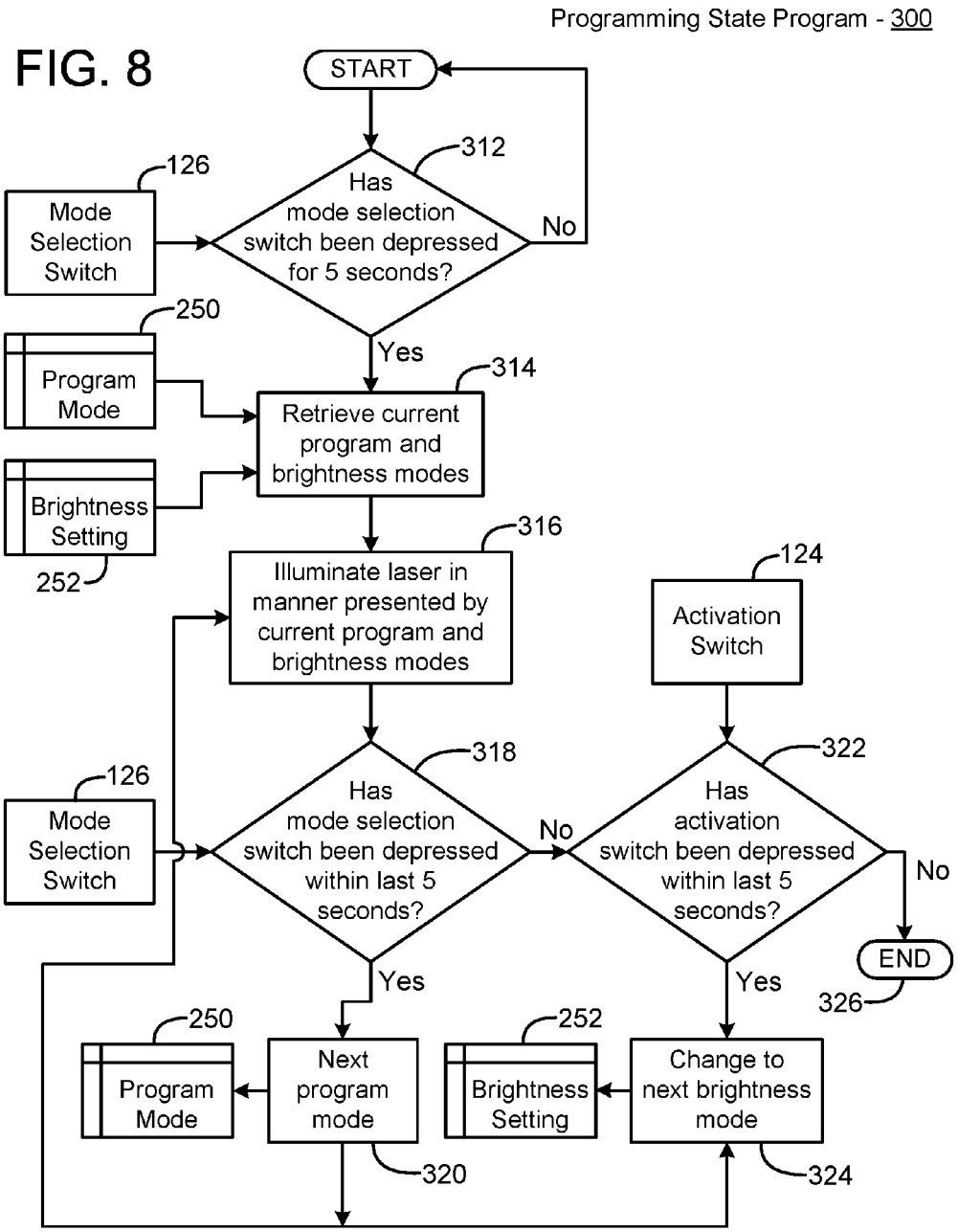
Programming State Program - 300
FIG. 8
START
312
Has mode selection switch been depressed for 5 seconds?
No
Yes
126
Mode Selection Switch
250
Program Mode
314
Retrieve current program and brightness modes
Brightness Setting
252
316
Illuminate laser in manner presented by current program and brightness modes
124
Activation Switch
318
Has mode selection switch been depressed within last 5 seconds?
No
322
Has activation switch been depressed within last 5 seconds?
No
END
326
Yes
Yes
126
Mode Selection Switch
250
Program Mode
Next program mode
320
252
Brightness Setting
Change to next brightness mode
324

FIREARM HANDGRIP ASSEMBLY WITH LASER GUNSIGHT SYSTEM

FIELD OF THE INVENTION

The present invention relates to firearm grip assemblies for handguns, and more particularly to a device that replaces the standard factory-supplied firearm handgrips without requiring significant modification of the firearm and enhances the functionality of the firearm by providing a laser gunsight operable by the user while the firearm is gripped by the handgrip in the firing position.

BACKGROUND OF THE INVENTION

Lasers are commonly used for firearm sighting when light conditions are poor, such as at night or in the darkened rooms of buildings. They are often used by police and military users of firearms, who need to be able to quickly and accurately aim the firearm at a poorly-illuminated target under low light conditions. They are increasingly popular for use with handguns, which are otherwise potentially difficult to aim and shoot accurately.

Laser sights have been developed that employ a battery-powered laser that has been sighted-in so that the laser illuminates the firearm's point of impact. The target reflects the laser beam back to the user, which informs the user exactly where the firearm is aimed and where the bullet will impact if the firearm is fired.

Various laser gunsight systems have been developed for use with firearms that are equipped with a handgrip. One example is the LG-401 LASERGRIPS® manufactured by Crimson Trace® of Wilsonville, Oreg. The standard factory-supplied grips are removed from the firearm and replaced by two panels that are screwed onto the firearm's frame. The two panels are connected by a front activation pad that wraps around the front strap of the firearm's handgrip. The handgrip is grasped by the user's hand when the firearm is being held in the firing position, and a laser attached to the top of the right grip is turned on while the front activation pad is depressed. The laser housing includes set screws to adjust the laser's elevation and windage when the laser is sighted-in by firing rounds at a target and noting any aiming error. The two batteries are capable of powering the laser for about four hours of illumination.

However, the LG-401 LASERGRIPS® has a significant disadvantage in that the sighting-in process of the laser has to be repeated every time the batteries are changed. One of the two batteries cannot be replaced unless the right grip holding the laser is removed from the firearm so the battery can be accessed and replaced. When the right grip is reattached, there is no guarantee the laser beam will still accurately reflect the firearm's point of impact. Battery replacement is recommended at least annually, and even more frequently for heavy users, which creates considerable inconvenience if a shooting range is not readily available. Furthermore, if the batteries begin to fail or experience a complete failure in the field, the user cannot replace them without taking the chance that the laser beam will no longer accurately indicate the firearm's point of impact.

The LG-401 LASERGRIPS® has an additional disadvantage in that its exterior mimics the standard hard factory-supplied firearm grips for handguns. It is often desirable to utilize firearm handgrip assemblies composed of rubber or other relatively soft elastomers instead. The use of a soft firearm handgrip assembly provides the user with a more secure grip. Such firearm handgrip assemblies often include ergonomic features such as finger ridges and palm swells to provide adequate security for holding the gun during recoil. The firearm handgrip assemblies may also provide a larger grip circumference than the standard factory-supply firearm handgrips to accommodate users with larger hands. Firearm grip assemblies may include rigid inserts for reinforcement of the elastomer material.

Therefore, a need exists for a new and improved firearm handgrip assembly that provides a laser gunsight system with batteries that can be changed without detaching the laser from the firearm and that provides ergonomic features. In this regard, the various embodiments of the present invention substantially fulfill at least some of these needs. In this respect, the firearm handgrip assembly according to the present invention substantially departs from the conventional concepts and designs of the prior art, and in doing so provides an apparatus primarily developed for the purpose of providing a laser gunsight system with batteries that can be changed without detaching the laser from the firearm and providing ergonomic features.

SUMMARY OF THE INVENTION

The present invention provides an improved firearm handgrip assembly with laser gunsight system, and overcomes the above-mentioned disadvantages and drawbacks of the prior art. As such, the general purpose of the present invention, which will be described subsequently in greater detail, is to provide an improved firearm grip sleeve with laser gunsight system that has all the advantages of the prior art mentioned above.

To attain this, the preferred embodiment of the present invention essentially comprises a first grip frame element adapted for mounting to a first portion of the firearm frame, the first grip frame element including at least one of an illuminator, a battery, a switch, and a controller, a cover portion of the grip defining an interior channel adapted to closely receive at least a major portion of the first portion of the firearm frame and the first grip frame element, the cover portion having a contoured exterior surface adapted for gripping by a user's hand, and a fastener operably engaging the cover portion to the firearm frame. The firearm frame may be a curved butt frame of a revolver. The interior channel of the cover portion may be curved. The fastener may include a threaded element connected to a lower end of the firearm frame, and a threaded fastener passing through a fastener aperture defined in the cover portion.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 8 is a flowchart of the programming state program for use with current embodiment of the firearm handgrip assembly with laser gunsight system of FIG. 1.

The same reference numerals refer to the same parts throughout the various figures.

DESCRIPTION OF THE CURRENT EMBODIMENT

Figure 2:
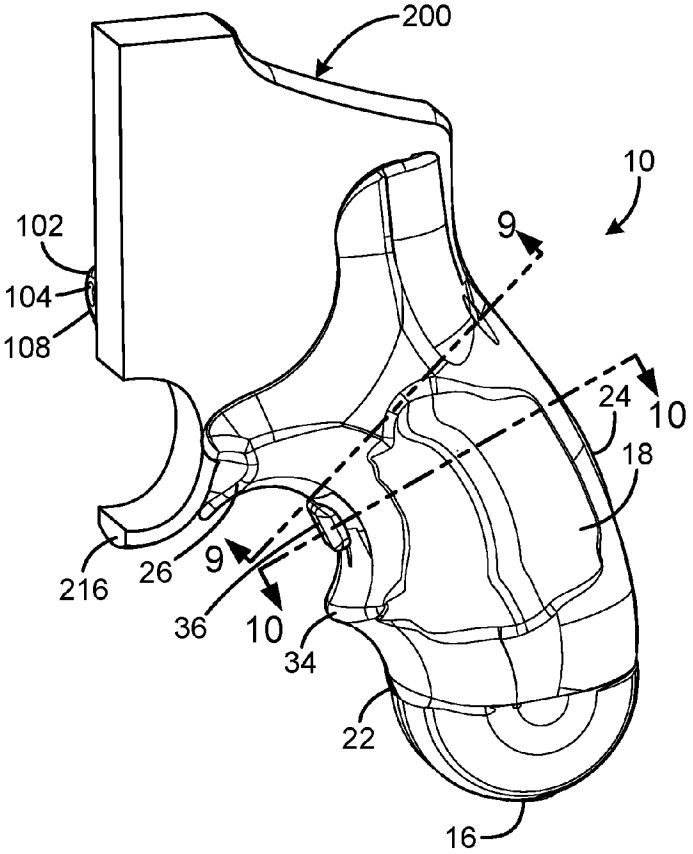
FIG. 2 is a left side isometric view of the firearm handgrip assembly with laser gunsight system of FIG. 1 installed on the pistol frame of a Smith & Wesson® J-Frame revolver.
Figure 1:
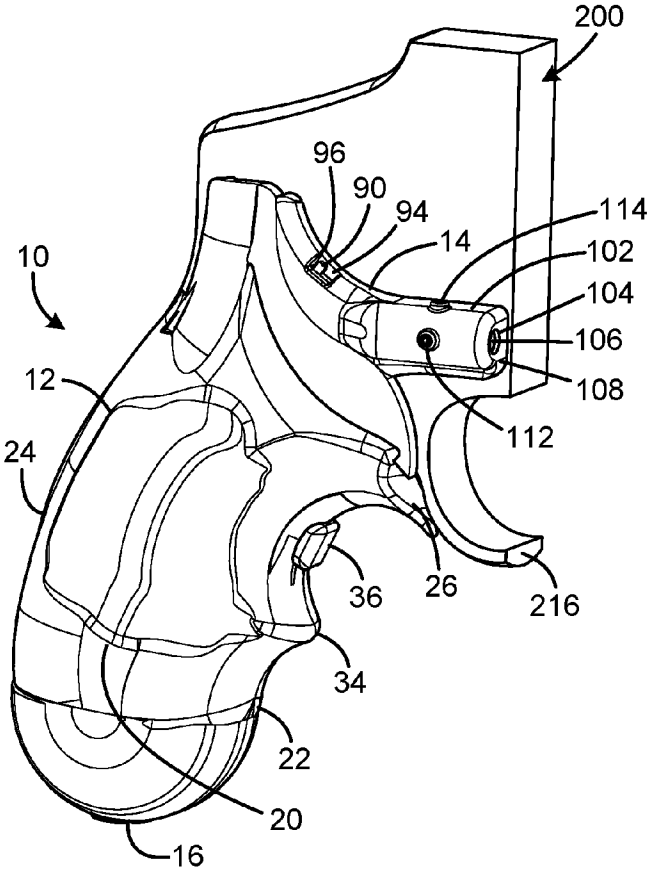
FIG. 1 is a right side isometric view of the current embodiment of a firearm handgrip assembly with laser gunsight system constructed in accordance with the principles of the present invention installed on the pistol frame of a Smith & Wesson® J-Frame revolver.
Figure 3:
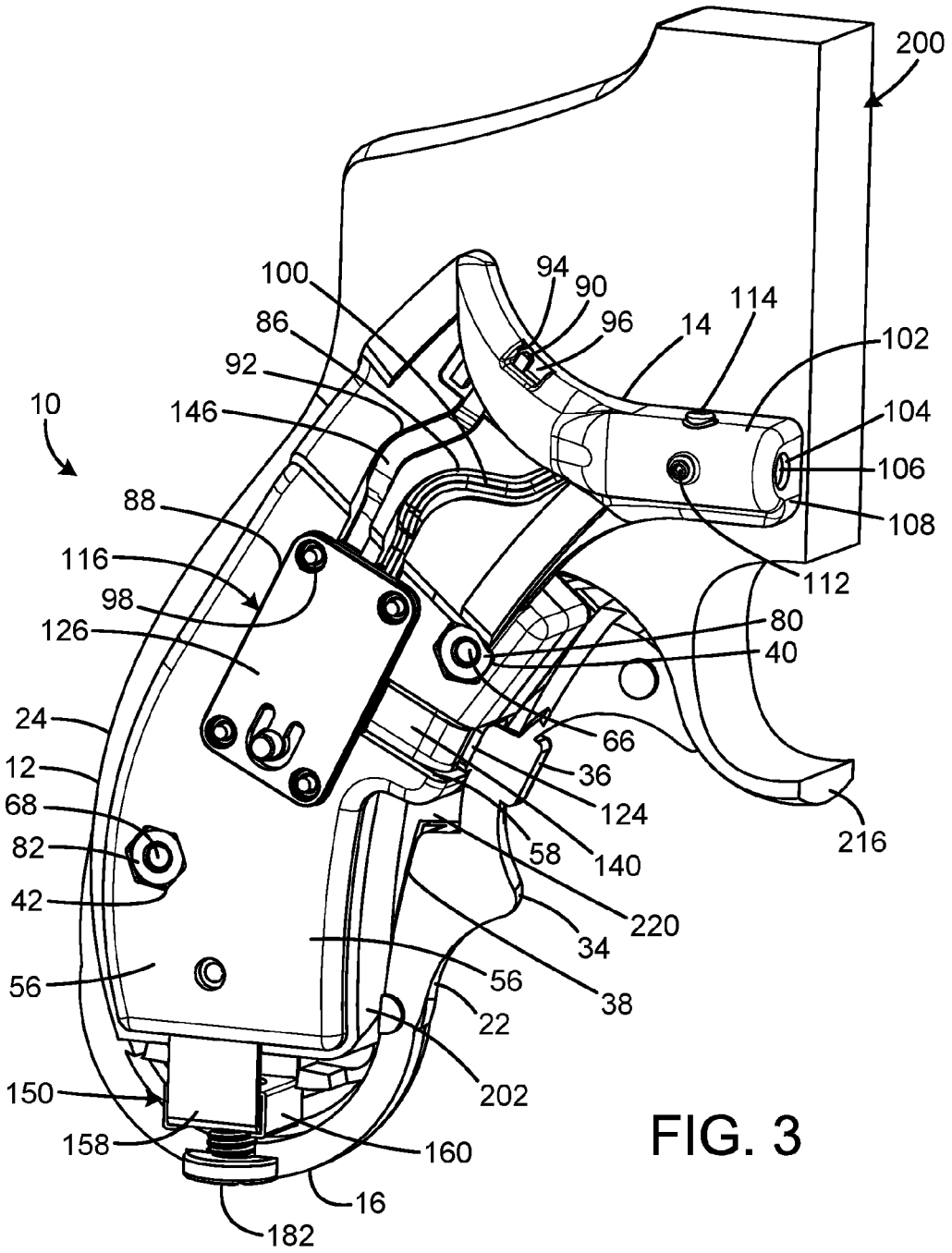
FIG. 3 is a right side sectional view of the firearm handgrip assembly with laser gunsight system of FIG. 1 installed on the pistol frame of a Smith & Wesson® J-Frame revolver.

An embodiment of the firearm handgrip assembly with laser gunsight system of the present invention is shown and generally designated by the reference numeral 10.

FIGS. 1-6 illustrate the improved firearm handgrip assembly with laser gunsight system 10 of the present invention for use with a pistol having removable grips. This type of pistol typically has a frame made from a lightweight metal, such as aluminum alloy, with a curved exterior surface adapted to be comfortably received in a user's hand. Only the frame 200 of the pistol is illustrated for clarity. More particularly, the frame shown is for a Smith & Wesson® J-Frame revolver.

The frame 200 has a downwardly-extending handgrip 202 that angles slightly rearward. The handgrip has a lower free end 206. The grip has flat or gently curved right and left side portions 208, 210, a gently curved front strap 212 facing forward, and a curved back strap 214 facing rearward. The handgrip generally has a rectangular cross-section. At the upper end of the front strap, a trigger guard 216 projects forward and upward to protect the trigger (not shown) from accidental activation.

The pistol frame 200 includes an aperture 226 in the handgrip 202 that receives a roll pin 224. With the factory-supplied grips installed, the handgrip has a curved and continuous surface to provide a secure comfortable grip, in the manner of any pistol. With the grips removed, the handgrip has discontinuities, steps, cavities, and other features that render it unsuitable for use.

Figure 4:
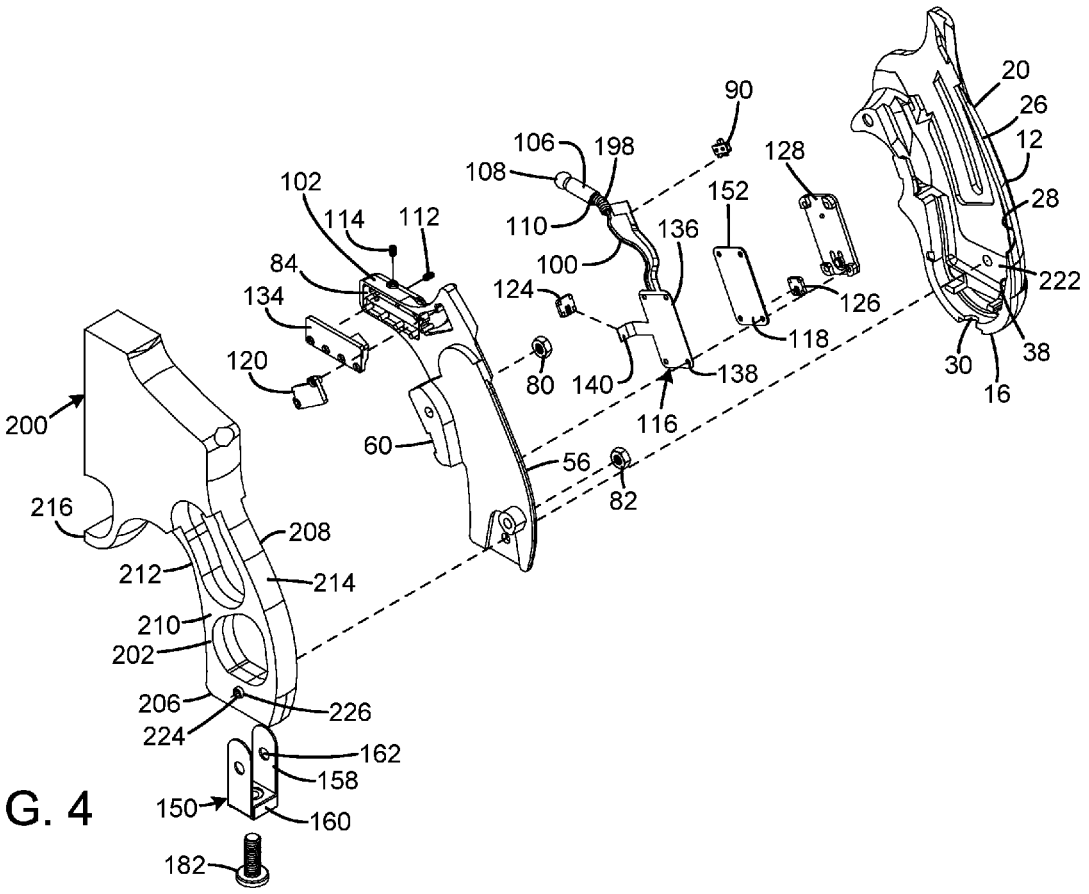
FIG. 4 is an exploded view of the right side of the current embodiment of the firearm handgrip assembly with laser gunsight system of FIG. 1.
Figure 5:
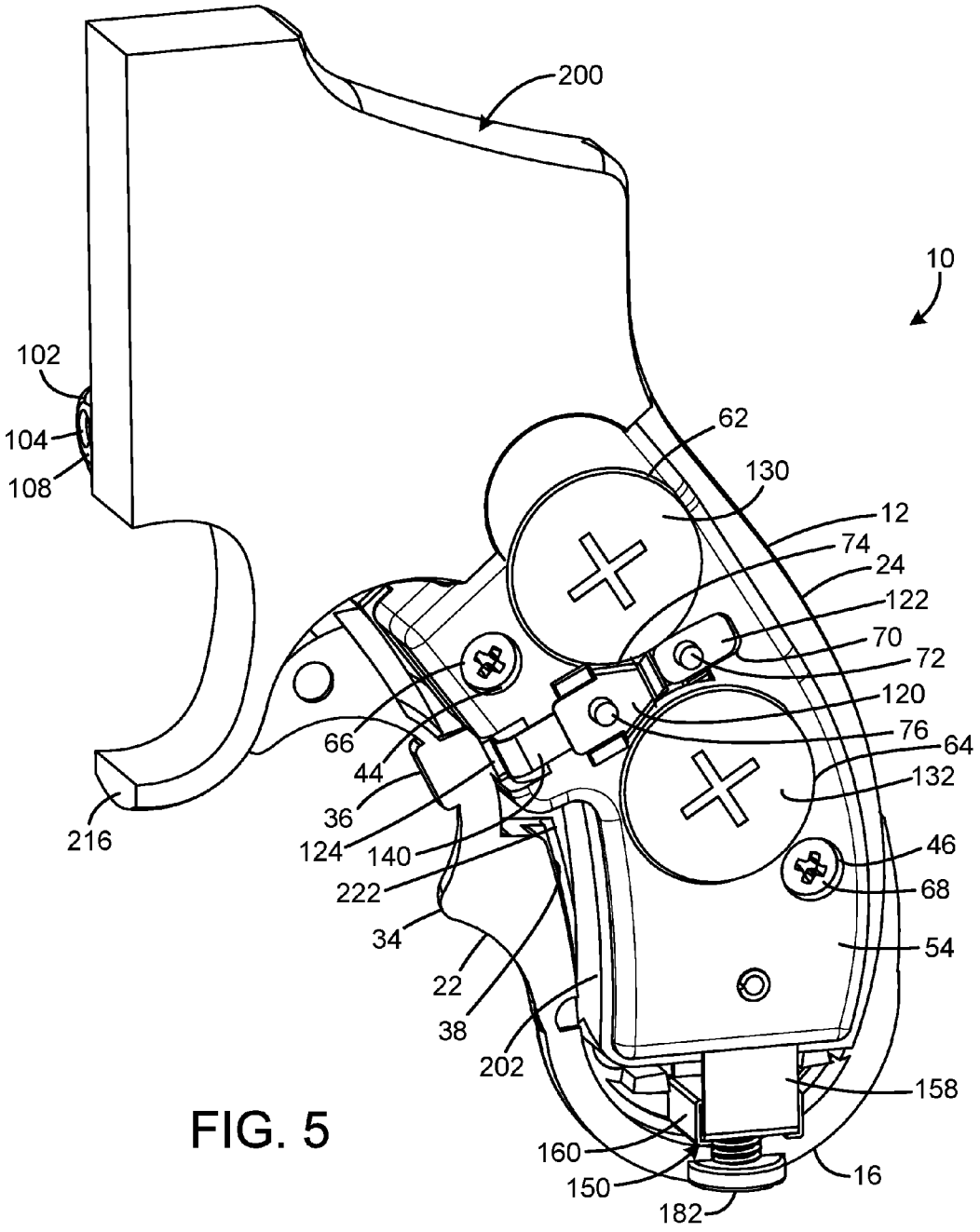
FIG. 5 is a left side sectional view of the firearm handgrip assembly with laser gunsight system of FIG. 1 installed on the pistol frame of a Smith & Wesson® J-Frame revolver.
Figure 6:
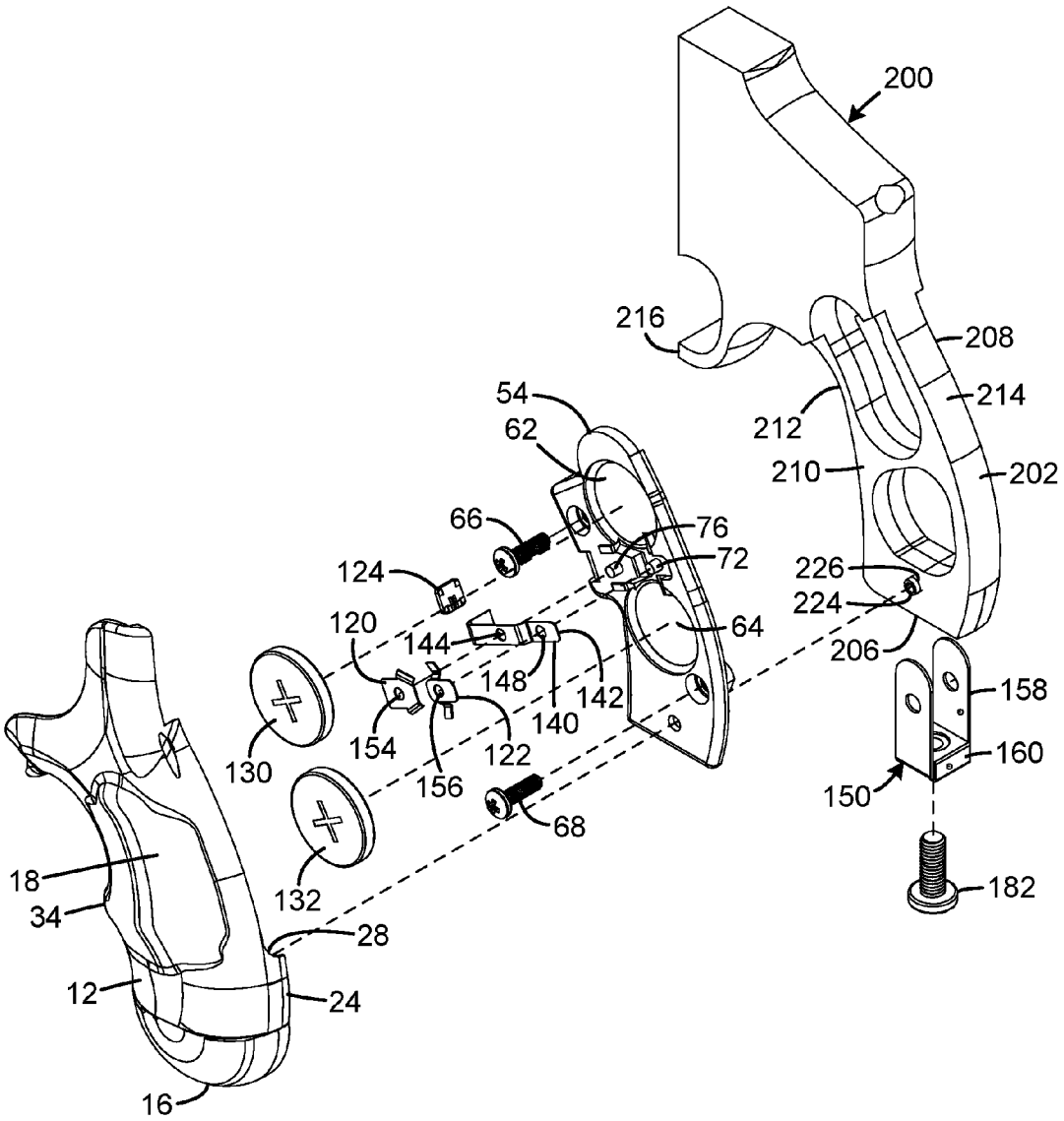
FIG. 6 is an exploded view of the left side of the current embodiment of the firearm handgrip assembly with laser gunsight system of FIG. 1.

The firearm handgrip assembly with laser gunsight system 10 of the present invention includes an exterior skin/cover portion 12 with a top 14, a bottom 16, a left side 18, a right side 20, a front 22, a rear 24, and an interior surface 38. FIGS. 4 and 6 depict the exterior skin as if it were composed of discrete first and second grip body halves for clarity, but the exterior skin is continuous in the current embodiment. As a result, the exterior skin provides a continuous contoured external surface adapted for gripping by a user's hand of the firearm handgrip assembly with laser gunsight system 10 when the firearm handgrip assembly with laser gunsight system is connected to the curved butt portion of a revolver frame 200. The top of the exterior skin defines a U-shaped trigger guard notch 26. The trigger guard notch provides clearance for the trigger guard 216. The bottom of the exterior skin defines a screw hole 30. The rear of the exterior skin defines a back strap notch 28 that exposes the back strap 214 of the handgrip 202 when the firearm handgrip assembly with laser gunsight system is connected to a frame 200. The role of the back strap notch is best shown in FIG. 8.

The exterior skin 12 is secured to the handgrip 202 by only a single fastener: a screw 182 threadedly received by stirrup clip 150 in the manner described in U.S. Pat. No. 4,199,887 to Hogue, which is incorporated by reference for all that it teaches therein. The stirrup clip has two upwardly extending stirrup straps 158 with apertures 162, and a stirrup nut 160.

A ridge 34 extends from the front 22 of the exterior skin 12. The ridge defines a plurality of grooves that receive the user's fingers when the pistol is held in a firing position. The front of the exterior skin also defines an activation switch cover 36. The activation switch cover is a flexible membrane in the current embodiment.

The top 14 of the right side 20 of the exterior skin 12 exposes a right plate/first grip frame element 56 that includes a laser housing 102. The laser housing has a forward facing aperture 104 that exposes the front 108 of a beam projection element/illuminator in the form of laser diode 106. The laser housing includes a windage screw 112 and an elevation screw 114 that adjust the position of the front of the laser diode to control the point of aim of a laser beam emitted by the laser diode through the forward facing aperture.

The left plate 54 defines an upper battery pocket 62, a lower battery pocket 64, a negative contact pocket 70, a negative contact post 72, a positive contact pocket 74, and a positive contact post 76.

The right plate 56 defines a laser diode pocket 84, a wires channel 86, a control circuit receptacle in the form of a PC board pocket 88, an on/off switch 90, an upper flex cable channel 92, an on/off switch pocket 94, a top aperture 96, and four PC board posts 98.

The right plate 56 defines two nut holes 40, 42, and the left plate 54 defines two screw holes 44, 46. The screw holes are axially registered with the nut holes so that screws 66, 68 and nuts 80, 82 can clamp the two plates to the frame 200. The right and left plates also each define half of an activation switch pocket 60.

The interior surface 38 of the exterior skin 12 receives a left overmold plate 220 and a right overmold plate 222, which are rigid. The overmold plates 220, 222 defines various features that receive portions of the left and right plates 54, 56 and the components installed on the plates 54, 56. The left and right plates are adapted to mount on opposed major faces of the pistol frame 200. The left and right plates are both planar members and parallel to each other in the current embodiment. The left and right plates are formed of a rigid material that does not flex during firearm operation, and the exterior skin includes an elastomeric surface portion. The exterior skin encompasses the left and right plates except for the illuminator frame portion/laser housing 102. The exterior skin is free of any electrical components and encompasses the front and sides of the handgrip 202 portion of the pistol frame in the current embodiment.

The presence of the left and right overmold plates 220, 222 results in the interior surface 38 of the exterior skin 12 forming the overmolded grip consisting predominantly of rigid plastic in the current embodiment. In the current embodiment, the exterior skin is made of thermoplastic elastomer (rubber). There are specific areas of the interior surface where no plastic exists because of the absence of the left and right overmold plates. In these strategic areas, the exposed rubber features allow moveable or compressible elements to be engaged by the user without resistance. An example of this type of feature is the activation switch cover 36 shown in FIGS. 1-3. Compression of the activation switch cover engages activation switch 124. Similarly, mode selection switch 126 is engaged with the same technique shown in FIG. 4. In the case of the mode selection switch, there is a switch cover plate 128 that provides enhanced control at that location while the user depresses the exterior skin 12 to engage the mode selection switch.

When the firearm handgrip assembly with laser gunsight system 10 is assembled for use, the left and right plates 54, 56 and the left and right overmold plates 220, 222 of the exterior skin 12 receive the laser gunsight system components of the present invention. More particularly, the laser gunsight system components include a laser diode 106, a circular coil spring 198, wires 100, a flex cable assembly 116, a PC board 118, a positive contact 120, a negative contact 122, an activation switch 124, a mode selection switch 126, a switch cover plate 128, upper and lower batteries 130, 132, and a laser cover plate 134. The laser diode has a front beam emitting end 108 and an opposed rear end 110. The flex cable assembly includes a rectangular portion 136 that defines four apertures 138, a conductive front flex cable 140 with a left end 142 that defines two apertures 144, 148, and a conductive upper flex cable 146. The PC board defines four apertures 152 that are axially aligned with the four apertures in the rectangular portion of the flex cable assembly. The mode selection switch is mounted on and electrically connected to the PC board. The positive contact defines an aperture 154. The negative contact defines an aperture 156.

When the firearm handgrip assembly with laser gunsight system 10 is assembled for use, the left and right plates 54, 56 and the left and right overmold plates 220, 222 of the exterior skin 12 receive the laser gunsight system components of the present invention. More particularly, the laser diode pocket 84 receives the laser diode 106 and spring 198. The laser cover plate 134 serves to further secure the laser diode within the laser diode pocket. The wires 100 electrically connect the laser diode to the rectangular portion 134 of the flex cable assembly 116 and are received within the wires channel 86. The PC board pocket 88 receives the PC board 118 and the rectangular portion 136 of the flex cable assembly 116. The apertures 152 in the PC board and the apertures 138 in the upper portion receive the PC board posts 98 to secure and align the PC board and rectangular portion within the PC board pocket. The front flex cable 140 is electrically connected to the rectangular portion. The upper flex cable 146 electrically connects the rectangular portion to the on/off switch 90 and is received within the upper flex cable channel 92. The on/off switch pocket 94 receives the on/off switch 90. The on/off switch is aligned with the aperture 96. The on/off switch cover plate 128 serves to further secure the on/off switch within the on/off switch pocket.

The activation switch 124 is received within the activation switch pocket 60. The activation switch is electrically connected to the midpoint of the front flex cable 140, which is received within the front flex cable channel 58. The left end 142 of the front flex cable and the positive contact 120 are electrically connected and received within the positive contact pocket 74. The aperture 144 in the left end and the aperture 154 in the positive contact receive the positive contact post 76 to secure and align the left end and positive contact within the positive contact pocket. The left end of the front flex cable and the negative contact 122 are electrically connected and received within the negative contact pocket 70. The aperture 156 in the negative contact and the aperture 148 in the left end receive the negative contact post 72 to secure and align the left end and the negative contact within the negative contact pocket. The upper battery 130 is received within the upper battery pocket 62, and the lower battery 132 is received within the lower battery pocket 64 to provide a power storage facility.

In the current embodiment, the on/off switch 128 enables the laser gunsight system to be operable when in the on position and to be inoperable when in the off position. The activation switch 124 is a momentary switch that enables the upper and lower batteries 130, 132 to power the laser diode 106 when depressed and prevents the laser diode from being powered when released. The activation switch has an on and an off position, and is biased to the off position so that it is in the on position only when pressure is applied by the user. The mode selection switch 126 determines the characteristics of the laser beam emitted by the laser diode. The available laser beam modes enabled when the activation switch is depressed can include continuously on at full power, dimmed, strobe, and momentary flicker. The mode can be changed by pressing and holding the mode selection switch for five seconds to enter a programming state, whereby the user can change the laser beam mode.

Figure 7:
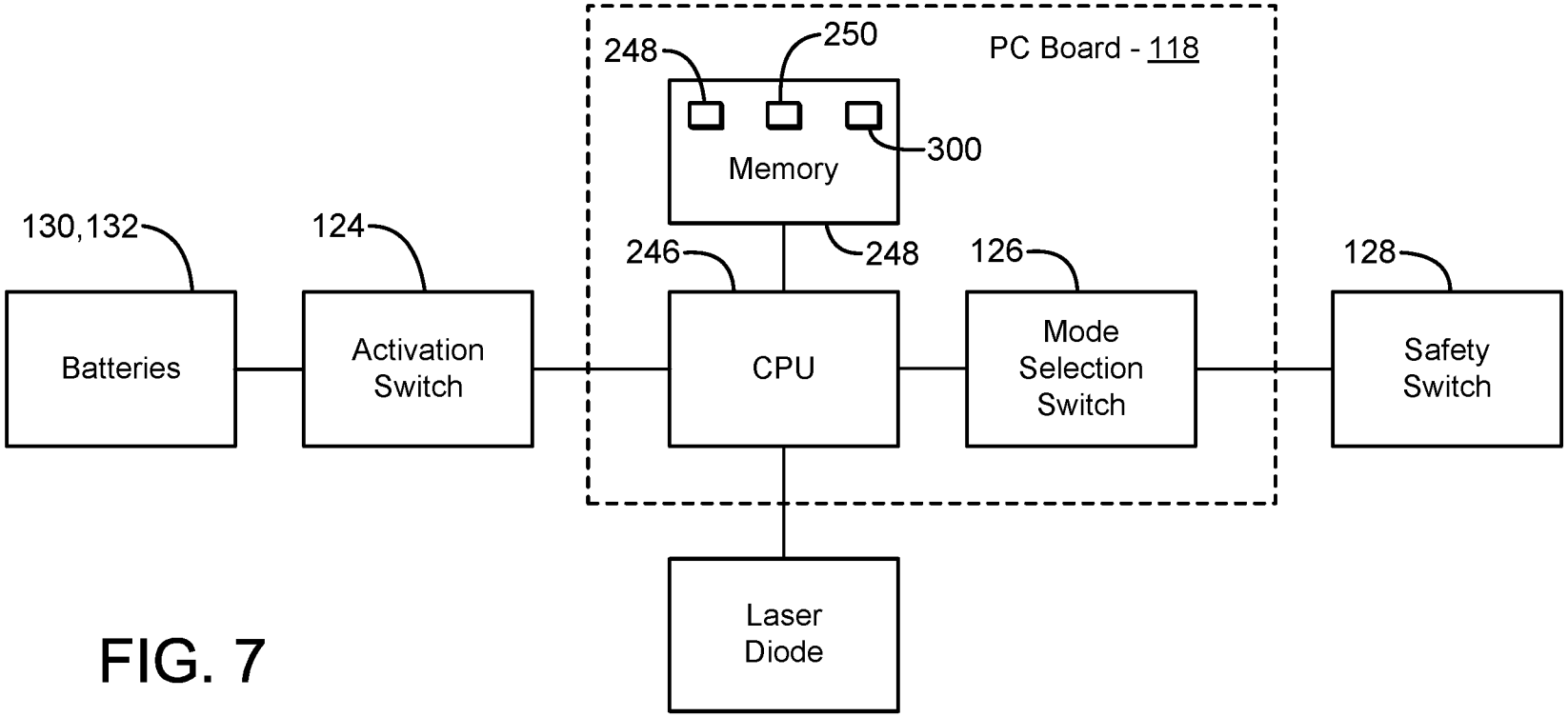
FIG. 7 is a block diagram of the current embodiment of the firearm handgrip assembly with laser gunsight system of FIG. 1.

FIG. 7 is a block diagram illustrating the improved firearm handgrip assembly with laser gunsight system 10 of the present invention. More particularly, the PC board 118 includes memory 248 connected to a Central Processing Unit (CPU) 246 and the mode selection switch 126. The memory stores the current program mode 250 and brightness setting 252, as well as programming state program 300. The CPU uses the current program mode and brightness setting to control the laser beam emitted by the laser diode 106 when the on/off switch 90 is in the on position and the activation switch 124 is actuated. When the activation switch is actuated, the CPU controls the flow of electricity from batteries 130, 132 to laser diode 106 to produce a laser beam having the characteristics prescribed by the current program mode and brightness setting.

The firearm handgrip assembly with laser gunsight system 10 (including the laser beam emitting laser diode 106 and controller CPU 246 with connected memory 248) has three switches connected to the controller. The first switch (on/off switch 90) is an on-off switch that prevents any operation when in a first position, and enables operation when in a second position. The on/off switch is stable in each position so that it remains in the selected position when set and released. A second switch (activation switch 124) is a momentary switch that is accessible for operation in a location while the user is gripping the gun for firing. The activation switch has an on and an off position, and is biased to the off position so that it is in the on position only when pressure is applied by the user. A third switch (mode selection switch 126) establishes the operating mode when the safety switch and activation switch are both on. The mode selection switch is also a momentary switch that is biased to an open position, and which sends a signal to the controller circuitry in response to momentary pressure (a tap or push). The controller has several operating modes, and sequential pushes on the mode selection switch cycle the controller through the different operating modes. The available operating modes will be discussed subsequently in the description of FIG. 8.

The first switch (on/off switch 90) is preferably a toggle switch located in the recessed on/off switch pocket 94, so that it is not accidentally switched, but may be switched only by deliberate action with a fingernail or small tool. The second switch (activation switch 124) is preferably located on the front strap 212 of a pistol handgrip 202 below the trigger guard 216, where the activation switch rests under the user's middle finger as it naturally grips the gun. The third switch (mode selection switch 126) is preferably located below a section of the overmolded exterior skin 12 that is soft rubber material only (no portions of the overmold plates 220, 222 cover the mode selection switch), and as such yields with intentional pressure so that the mode selection switch will be engaged. Operation of the mode selection switch requires a deliberate pressure with a fingertip.

The activation and mode selection switches 124, 126 include a flexible exterior skin membrane 12 covering them, such that pressure on the flexible portion of the exterior skin operates the activation switch (activation switch cover 36 covers the activation switch). The membrane is coextensive to cover the grip panels (left and right plates 54, 56) to provide a resilient gripping surface.

When the firearm handgrip is gripped by a user's hand for firing, the activation switch 124 will be covered by the user's finger for selectable actuation, mode selection switch 126 will be covered by the palm of the user's hand to prevent actuation, and the on/off switch 90 will be away from the user's hand to avoid actuation. The controller has electrical connections to each of the three switches.

FIG. 8 is a flowchart of the programming state program 300 for use with the improved firearm handgrip assembly with laser gunsight system 10 of the present invention. More particularly, the program starts (310) by checking if the mode selection switch 126 has been depressed for 5 seconds (312). If the mode selection switch has been depressed for five seconds, the CPU 246 retrieves the current program mode 250 and brightness setting 252 from memory 248. Subsequently, the CPU causes the laser diode 106 to illuminate in the manner prescribed by the current program mode and brightness setting (316). If the mode selection switch has been depressed within the last five seconds (318), the CPU changes the current program mode to the next program mode and stores the change as the current program mode in memory 248. The program then returns to step 316, which gives the user an opportunity to view the result and make additional changes to the characteristics of the laser beam if desired.

If the mode selection switch 126 has not been depressed within the last five seconds at step 318, the program checks if the activation switch 124 has been depressed within the last five seconds (322). If the activation switch has been depressed within the last five seconds, the CPU 246 changes the current brightness setting to the next brightness setting and stores the change as the current brightness setting in memory 248. The program then returns to step 316, which gives the user an opportunity to view the result and make additional changes to the characteristics of the laser beam if desired. Once five seconds have passed without the user pressing either the mode selection switch or the activation switch, the program ends (326).

In the current embodiment, the mode selection switch 126 is used to cycle between flashing, stealth target, or steady modes. In flashing mode, the laser will blink twice per second while the activation switch 124 is depressed. In stealth target mode, a press of the activation switch activates a burst of three quick flashes of the laser beam, then the laser diode turns off for stealth targeting. This mode will repeat with each press of the activation button. The user can hold the activation button down to override the stealth target mode and enter steady mode. In steady mode, pressing and holding the activation button results in a continuous laser beam.

In the current embodiment, the activation switch 124 is used in the programming state to set one of three levels of laser beam brightness. Each time the activation switch is pressed and released in the programming state, the laser beam's brightness will be reduced by one level. After the minimum brightness level setting is reached, the next press of the activation switch will return the laser beam's brightness to the maximum brightness setting.

Figure 10:
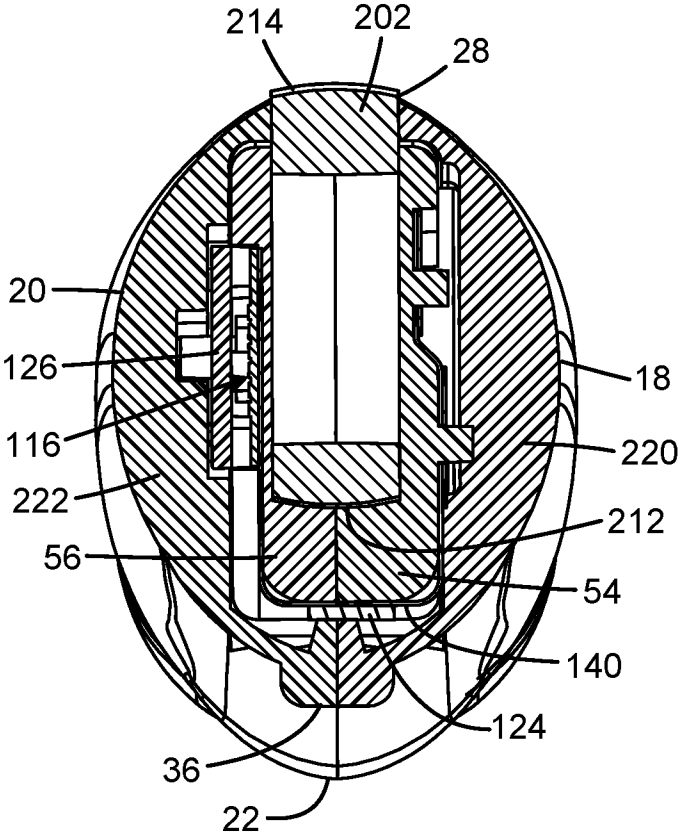
FIG. 10 is a sectional view taken along line 10-10 of FIG. 2.
Figure 9:
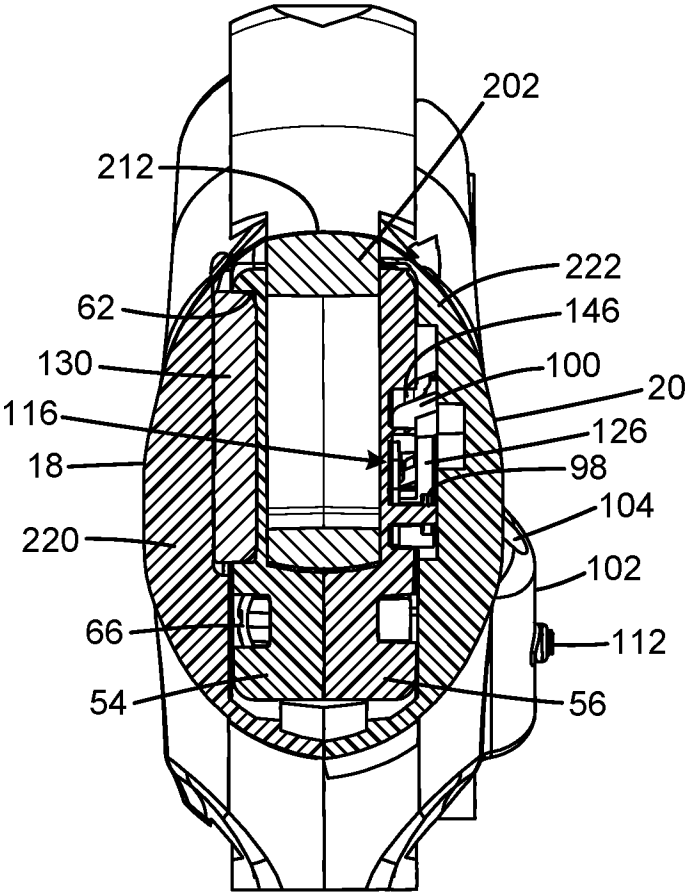
FIG. 9 is a sectional view taken along line 9-9 of FIG. 2.

FIGS. 9 and 10 illustrate the results of the overmold process used to manufacture the improved firearm handgrip assembly with laser gunsight system 10 of the present invention. More particularly, in the current embodiment the firearm handgrip assembly with laser gunsight system 10 is a unitary molded piece comprising two materials. The exterior skin 12 is made of thermoplastic elastomer in the current embodiment. However, the exterior skin may be any elastomeric material preferably having a minimum durometer hardness of 30 A in order to provide adequate firmness to retain shape and resist dislocation, and preferably having a hardness of no more than 80 A so the material maintains sufficient elasticity to be comfortable to grip. The left and right overmold plates 220, 222 are a rigid material, which is a hard plastic element molded into the rubber exterior skin in the current embodiment. It is desirable for the two materials to form a chemical bond between them. Such a molding process is described in U.S. Pat. No. 6,301,817 (Hogue et al.). Prior to the overmolding process, the exterior skin and the left and right overmold plates are fabricated as discrete components.

Figure 11:
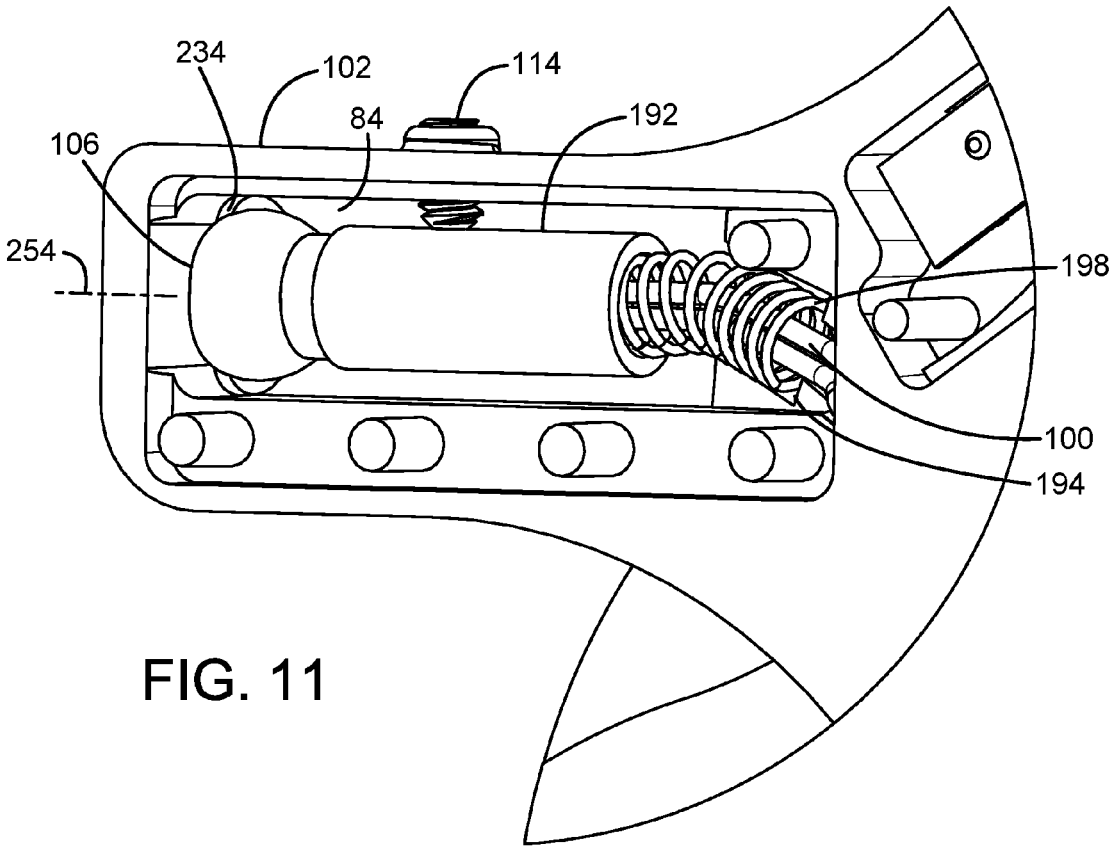
FIG. 11 is an enlarged view of the laser pocket of FIG. 4 with the laser diode installed and the laser cover plate removed.
Figure 12:
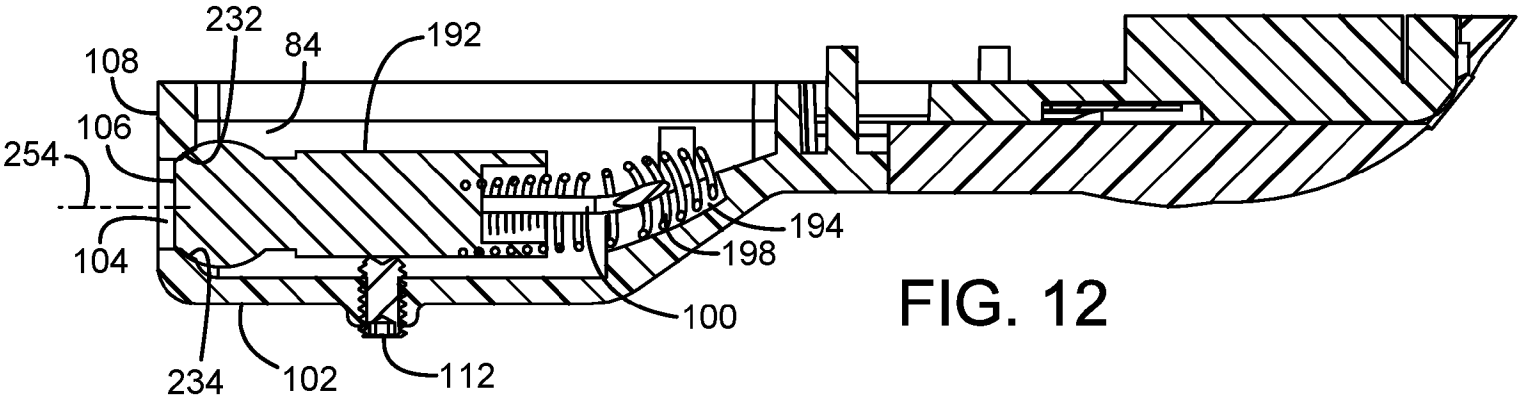
FIG. 12 is a sectional view of the laser pocket of FIG. 4 with the laser diode installed.
Figure 13:
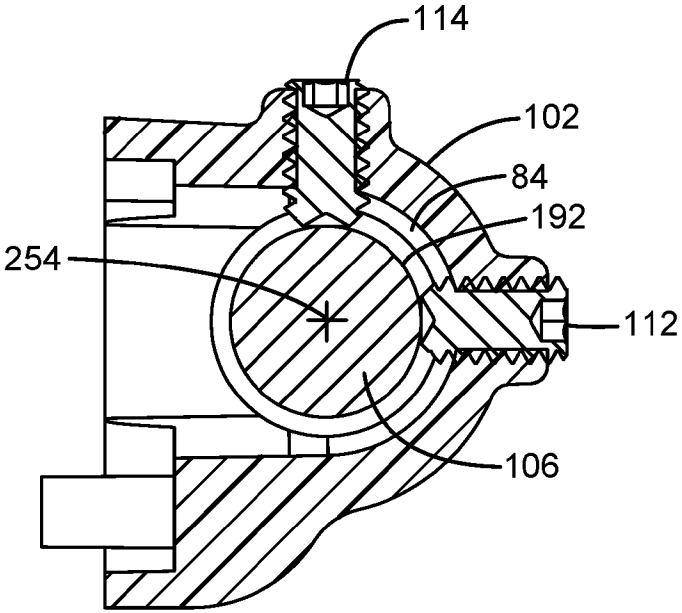
FIG. 13 is a sectional view of the laser pocket of FIG. 4 with the laser diode installed.

FIGS. 11-13 illustrate the improved laser housing 102 and laser diode 106 of the present invention. More particularly, the rear 110 of the laser diode has a central bore 194 that receives one end of the circular coil spring 198. The circular coil spring not only provides stress relief for the wires 100 as the wires enter the wires channel 86, but the spring also urges the exterior surface 192 of the laser diode against the windage screw 112 and elevation screw 114, thereby fixing the laser diode in place within the laser diode pocket 84 of the laser housing. As a result, the point of aim of a laser beam emitted by the front 108 of the laser diode through the front facing aperture 104 of the laser housing along optical axis 254 is determined and can be adjusted by the extent to which the windage screw and elevation screw penetrate into the laser diode pocket. Curved surfaces 232, 234 adjacent to the front facing aperture form a socket that engages with the spherical surface portion of the front of laser diode to form a ball and socket joint, which enables the front of the laser diode to pivot within the socket. The spring also serves to bias the spherical surface portion of the front of the laser diode towards the socket.

Figure 14:
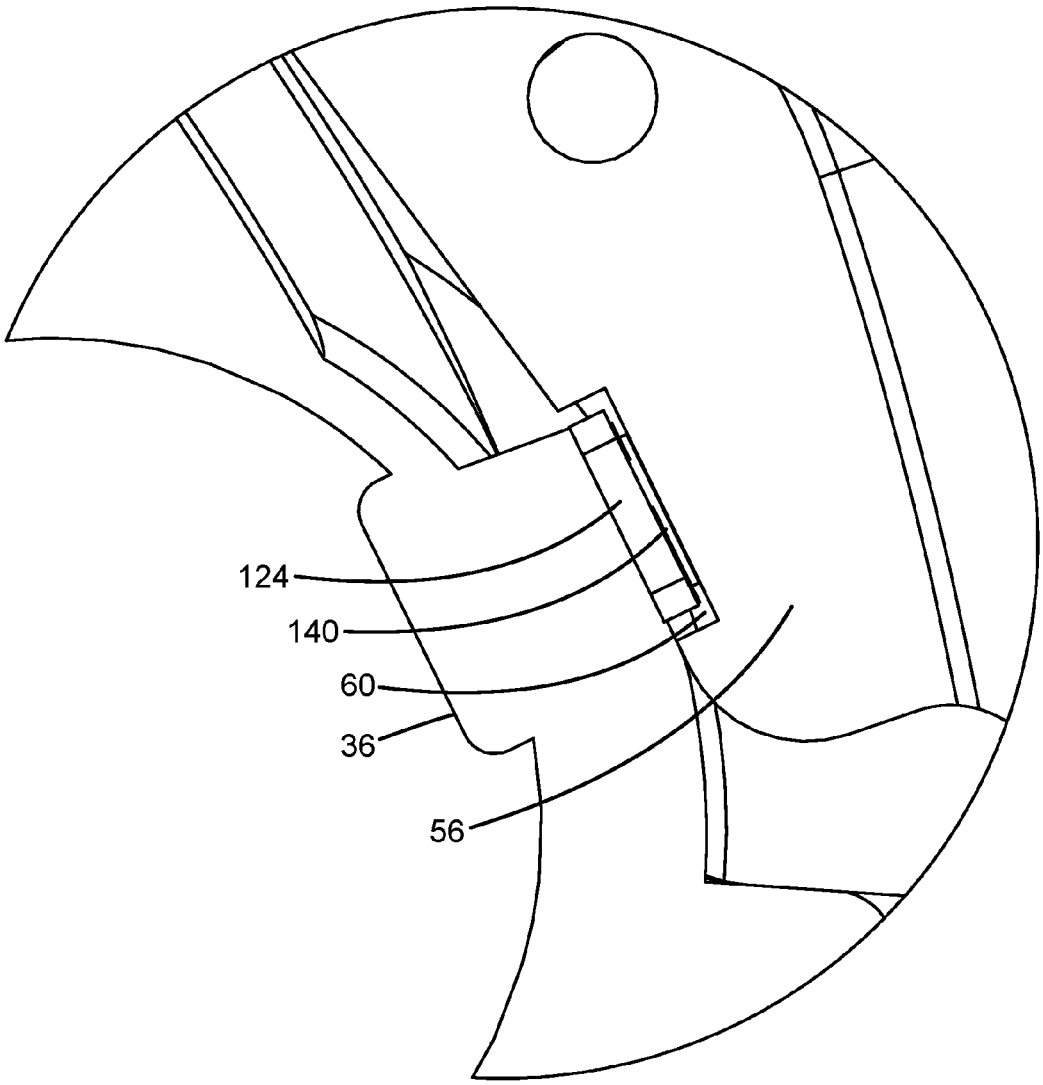
FIG. 14 is an enlarged view of the activation switch pocket of FIG. 4 with the activation switch installed.
Figure 15A:
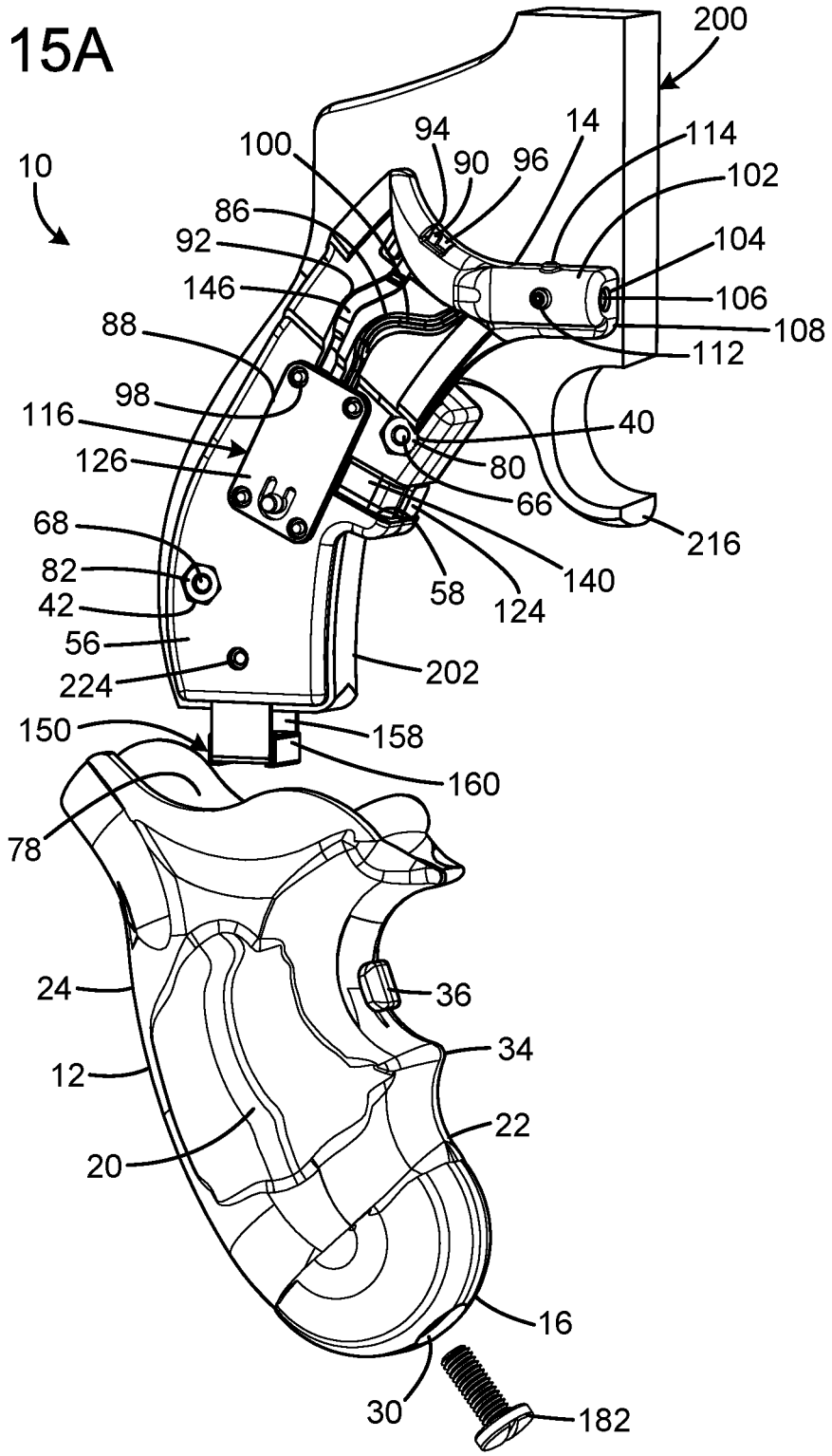
FIG. 15A is a right side view of the firearm handgrip assembly with laser gunsight system of FIG. 1 at the first stage of installation of the exterior skin onto the pistol frame of a Smith & Wesson® J-Frame revolver.
Figure 15B:
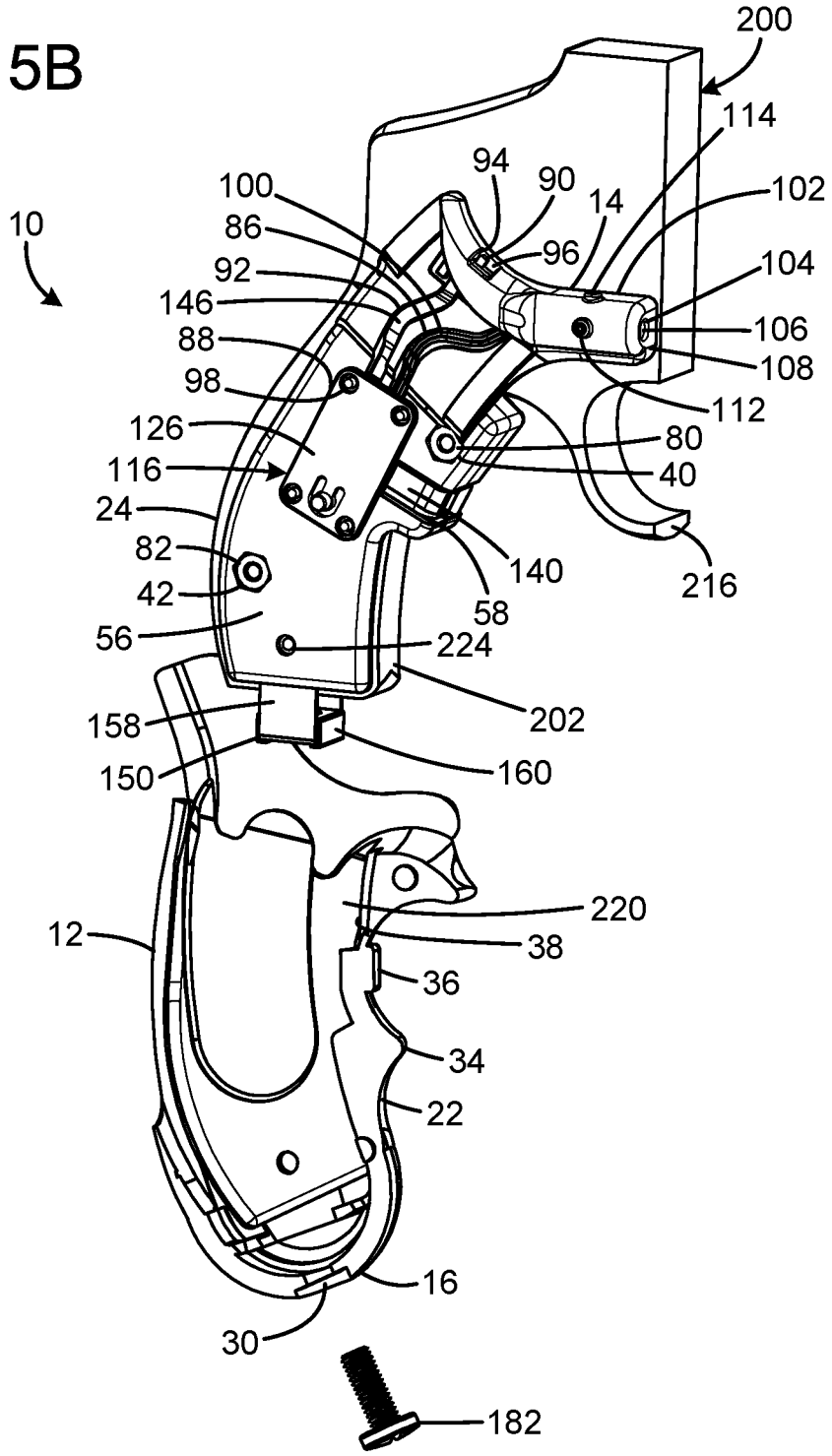
FIG. 15B is a right side sectional view of the firearm handgrip assembly with laser gunsight system of FIG. 1 at the first stage of installation of the exterior skin onto the pistol frame of a Smith & Wesson® J-Frame revolver.
Figure 16A:
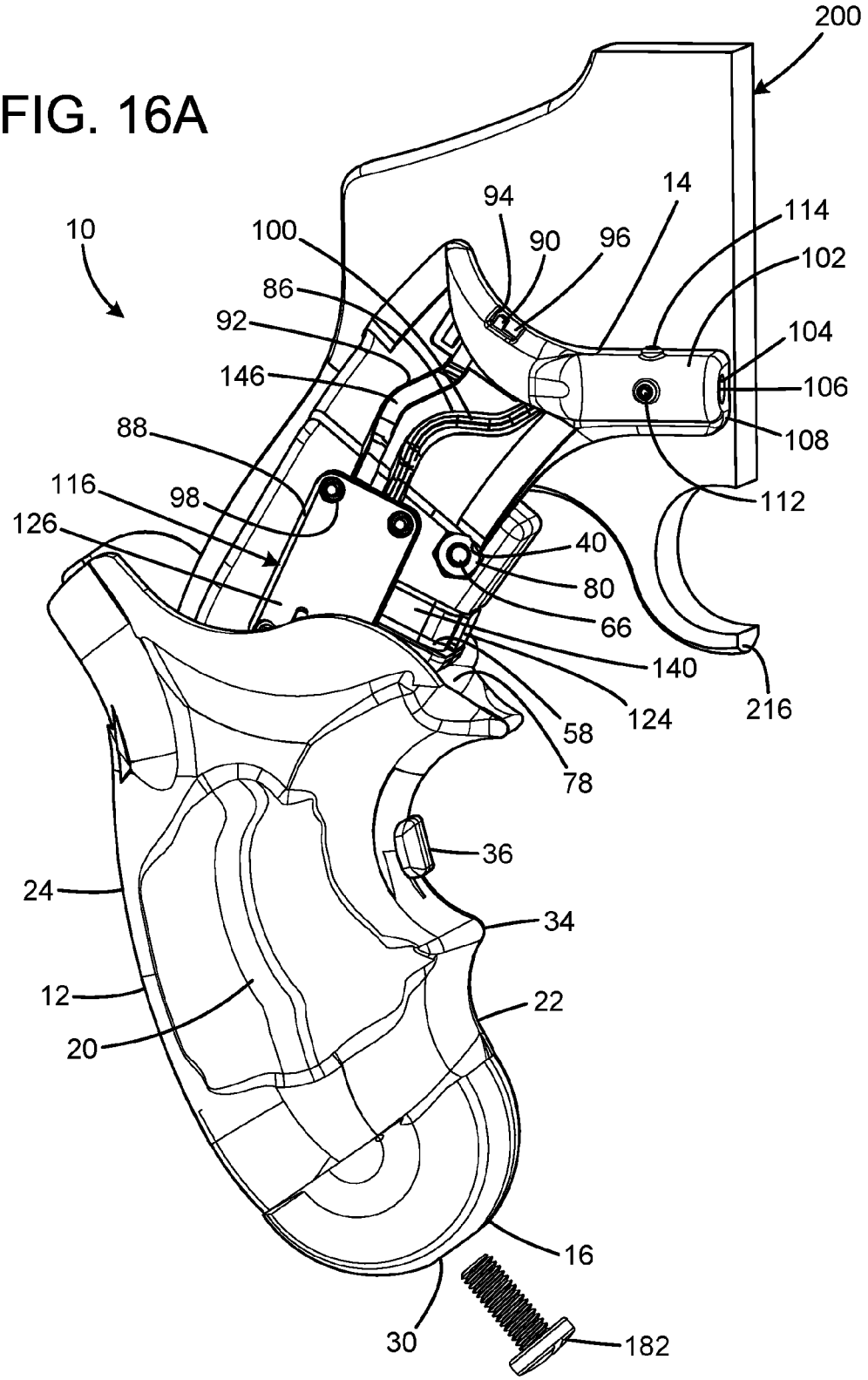
FIG. 16A is a right side view of the firearm handgrip assembly with laser gunsight system of FIG. 1 at the second stage of installation of the exterior skin onto the pistol frame of a Smith & Wesson® J-Frame revolver.
Figure 16B:
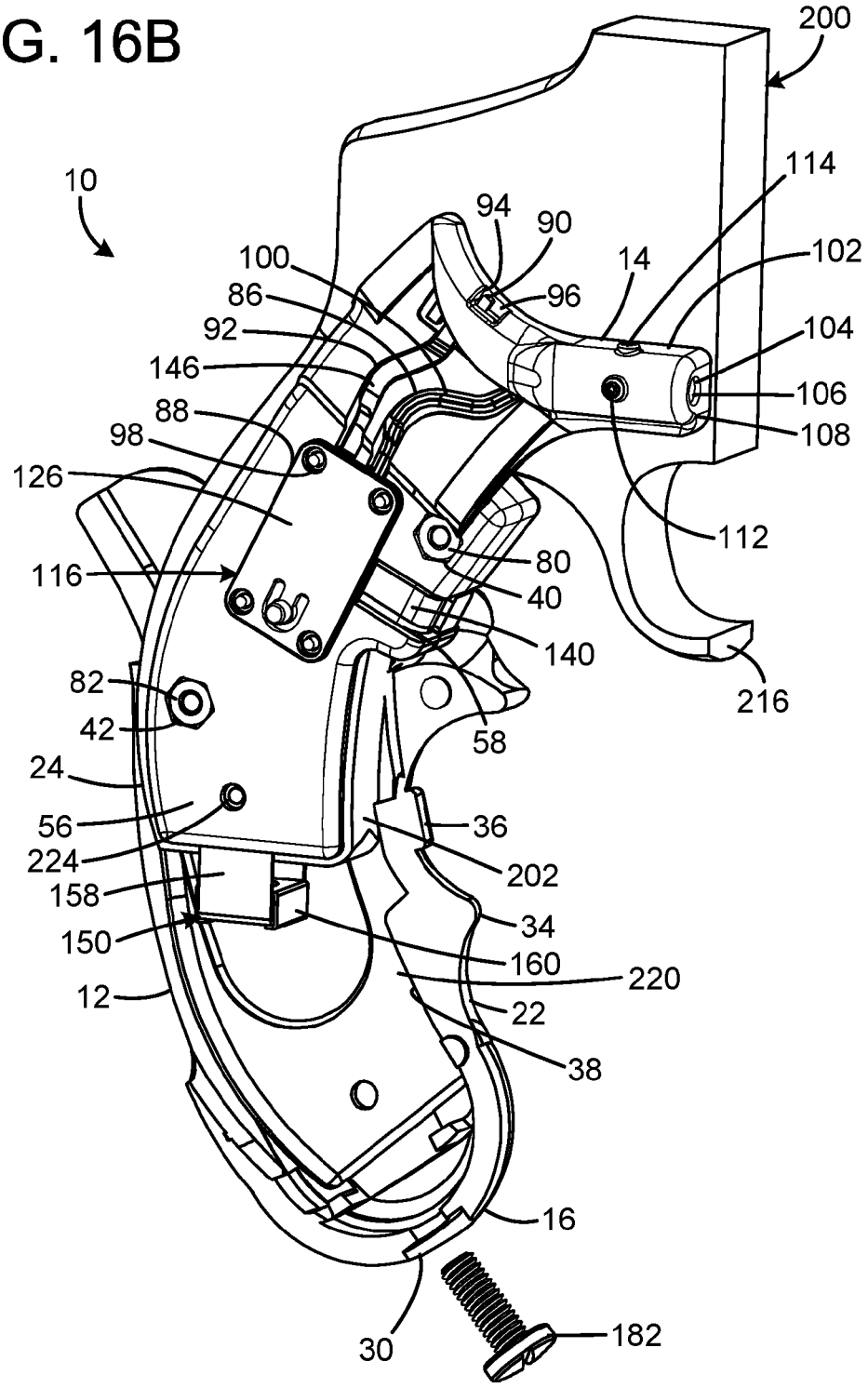
FIG. 16B is a right side sectional view of the firearm handgrip assembly with laser gunsight system of FIG. 1 at the second stage of installation of the exterior skin onto the pistol frame of a Smith & Wesson® J-Frame revolver.

FIG. 14 illustrates the improved activation switch cover 36 and activation switch pocket 60 of the present invention. More particularly, the activation switch pocket is located in the middle of the front edges of the left and right plates 54, 56 and is in communication with the front flex cable channel 58. The activation switch pocket receives the activation switch 124. The activation switch is held in the activation switch pocket by the activation switch cover 36. The activation switch cover 36 is a membrane that both protects the activation switch from the external environment and flexes to allow the activation switch to be actuated when the user squeezes the activation switch cover.

Figure 17:
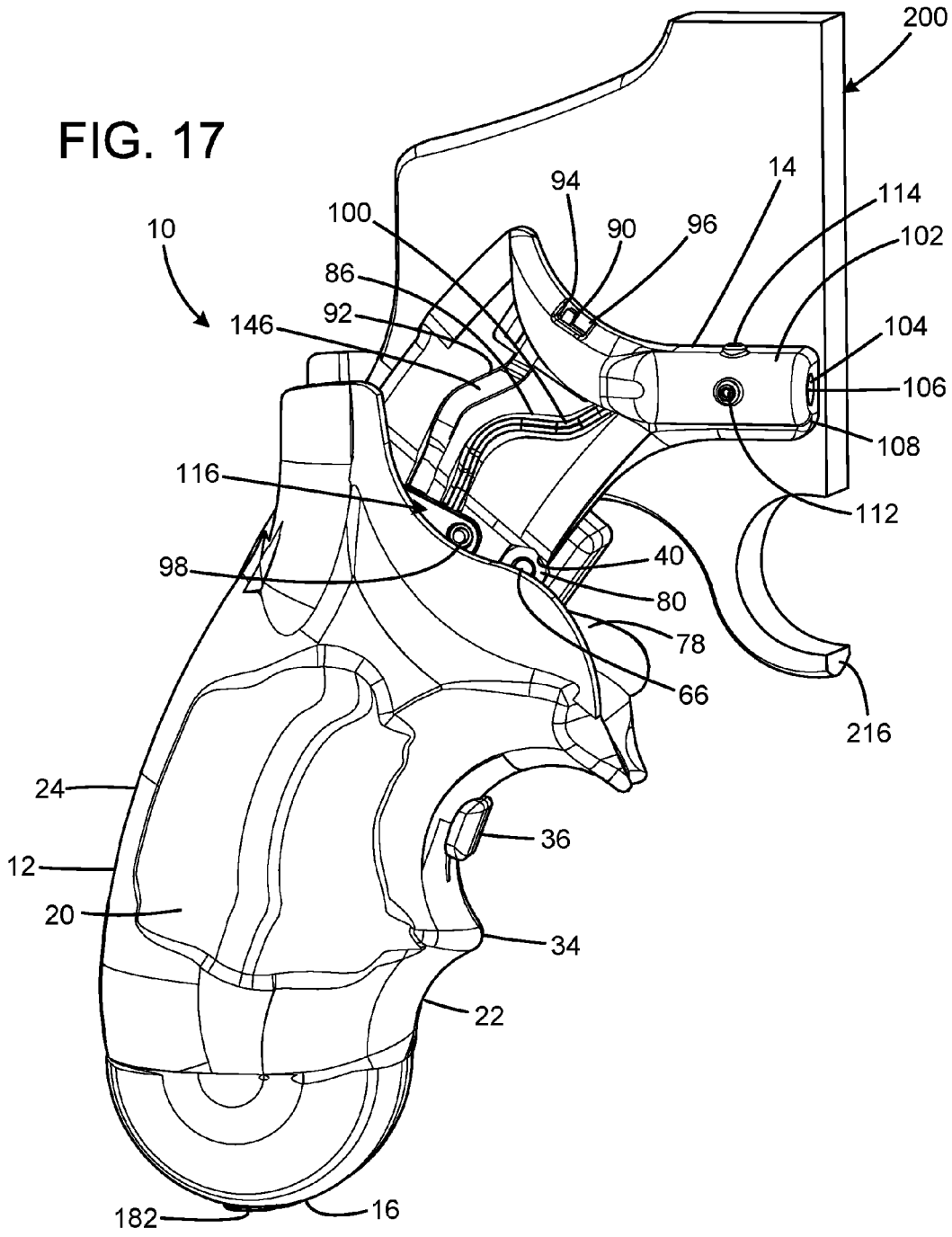
FIG. 17 is a right side view of the firearm handgrip assembly with laser gunsight system of FIG. 1 at the third stage of installation of the exterior skin onto the pistol frame of a Smith & Wesson® J-Frame revolver.
Figure 18A:
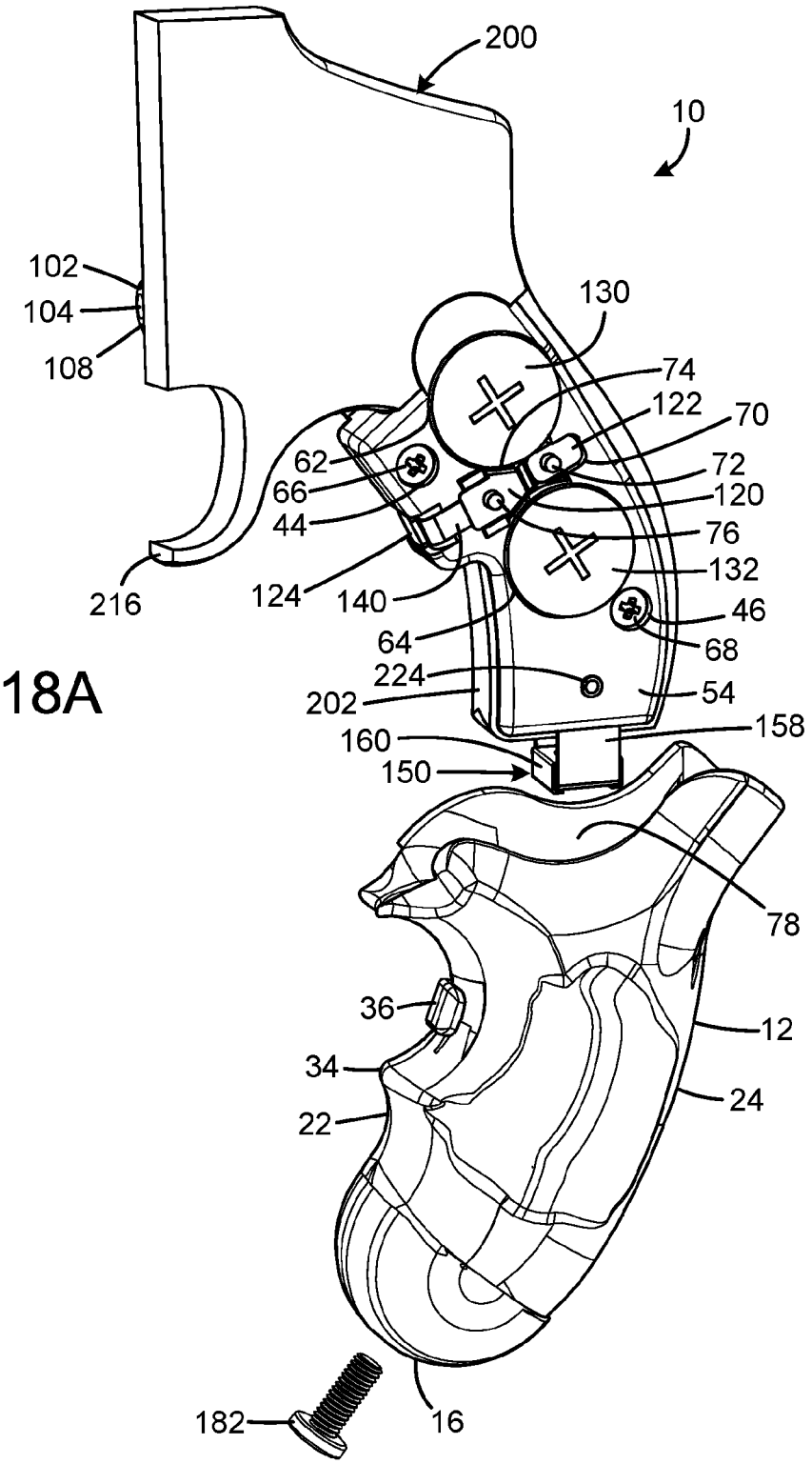
FIG. 18A is a left side view of the firearm handgrip assembly with laser gunsight system of FIG. 1 at the first stage of installation of the exterior skin onto the pistol frame of a Smith & Wesson® J-Frame revolver.
Figure 18B:
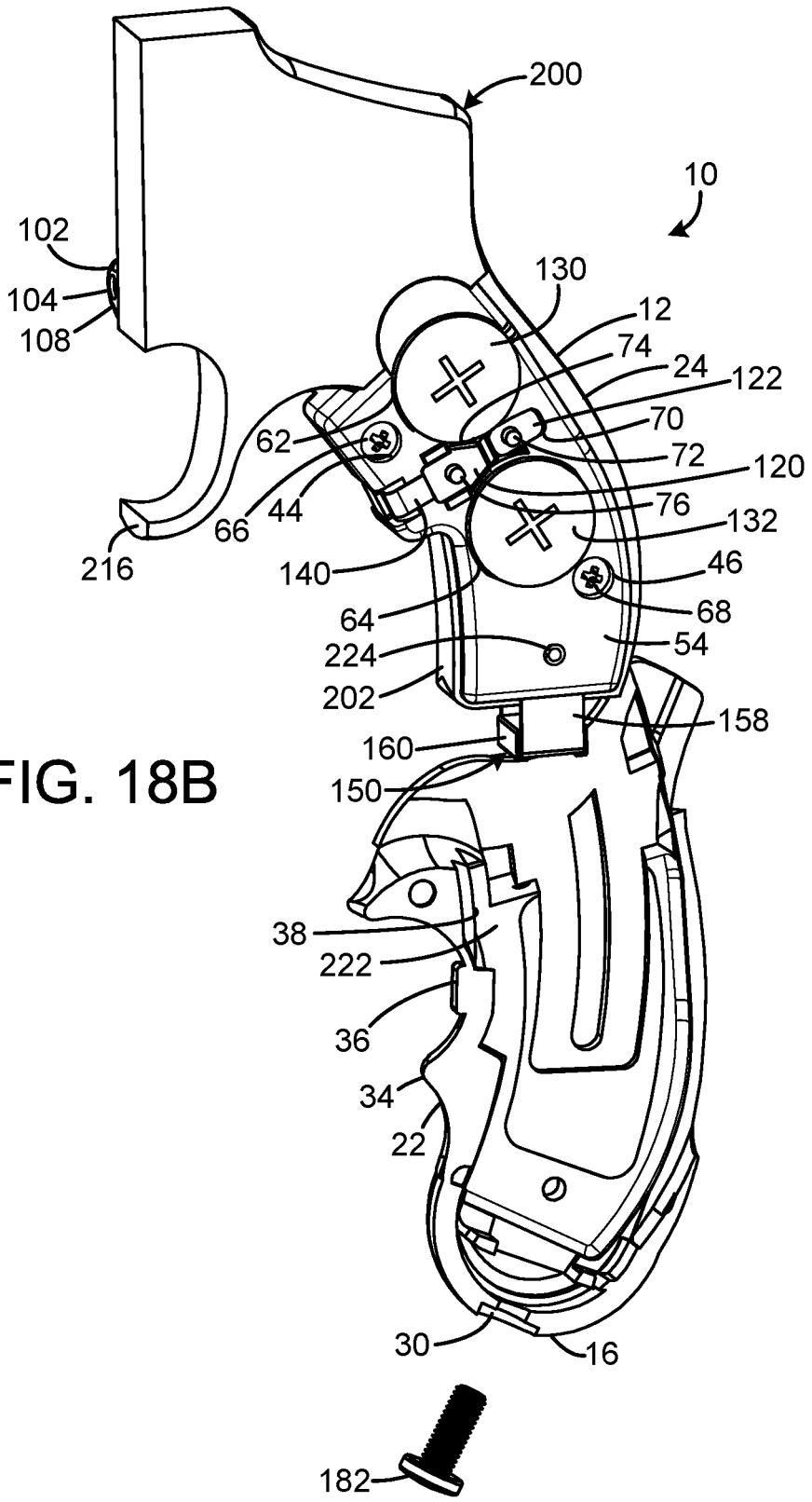
FIG. 18B is a left side sectional view of the firearm handgrip assembly with laser gunsight system of FIG. 1 at the first stage of installation of the exterior skin onto the pistol frame of a Smith & Wesson® J-Frame revolver.
Figure 19A:
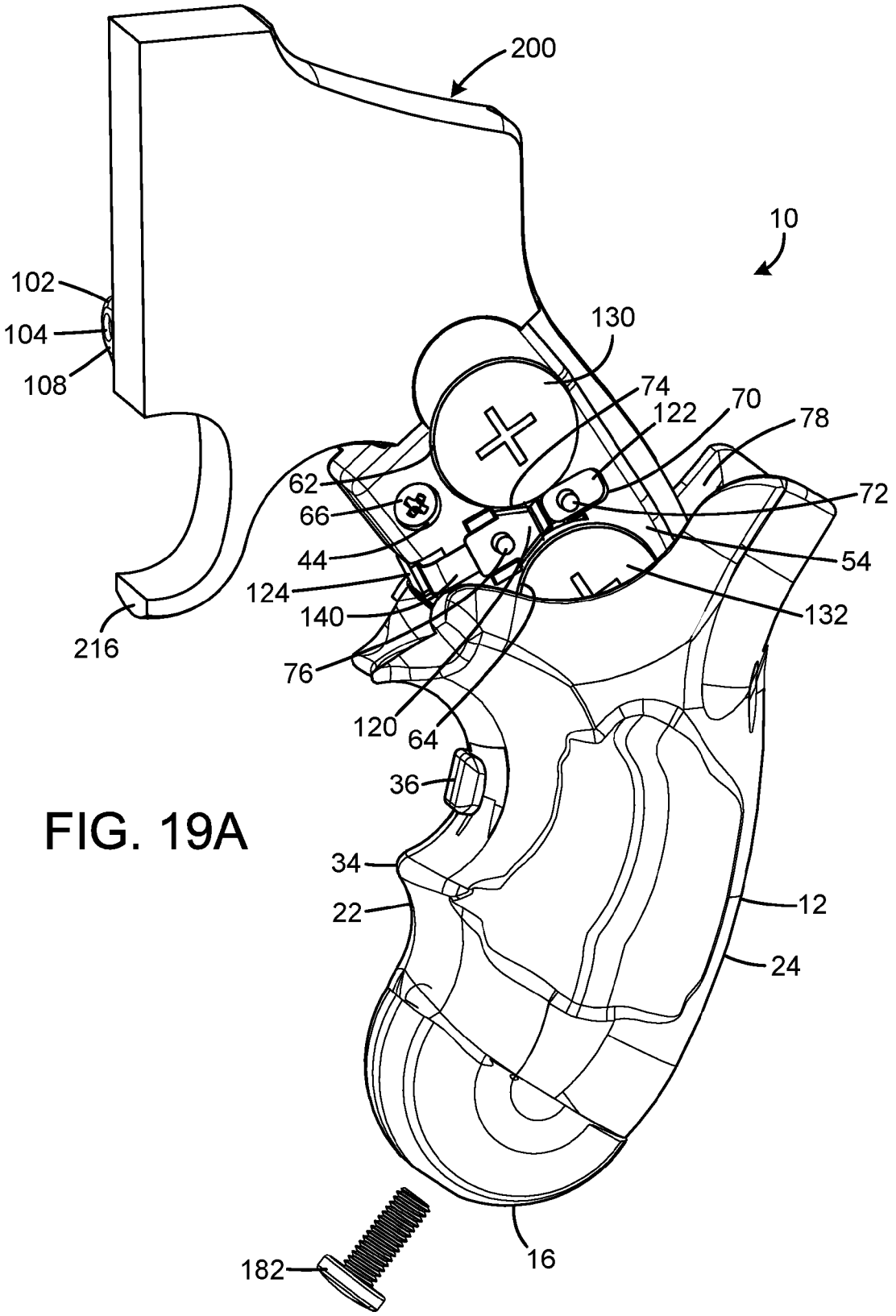
FIG. 19A is a left side view of the firearm handgrip assembly with laser gunsight system of FIG. 1 at the second stage of installation of the exterior skin onto the pistol frame of a Smith & Wesson® J-Frame revolver.
Figure 19B:
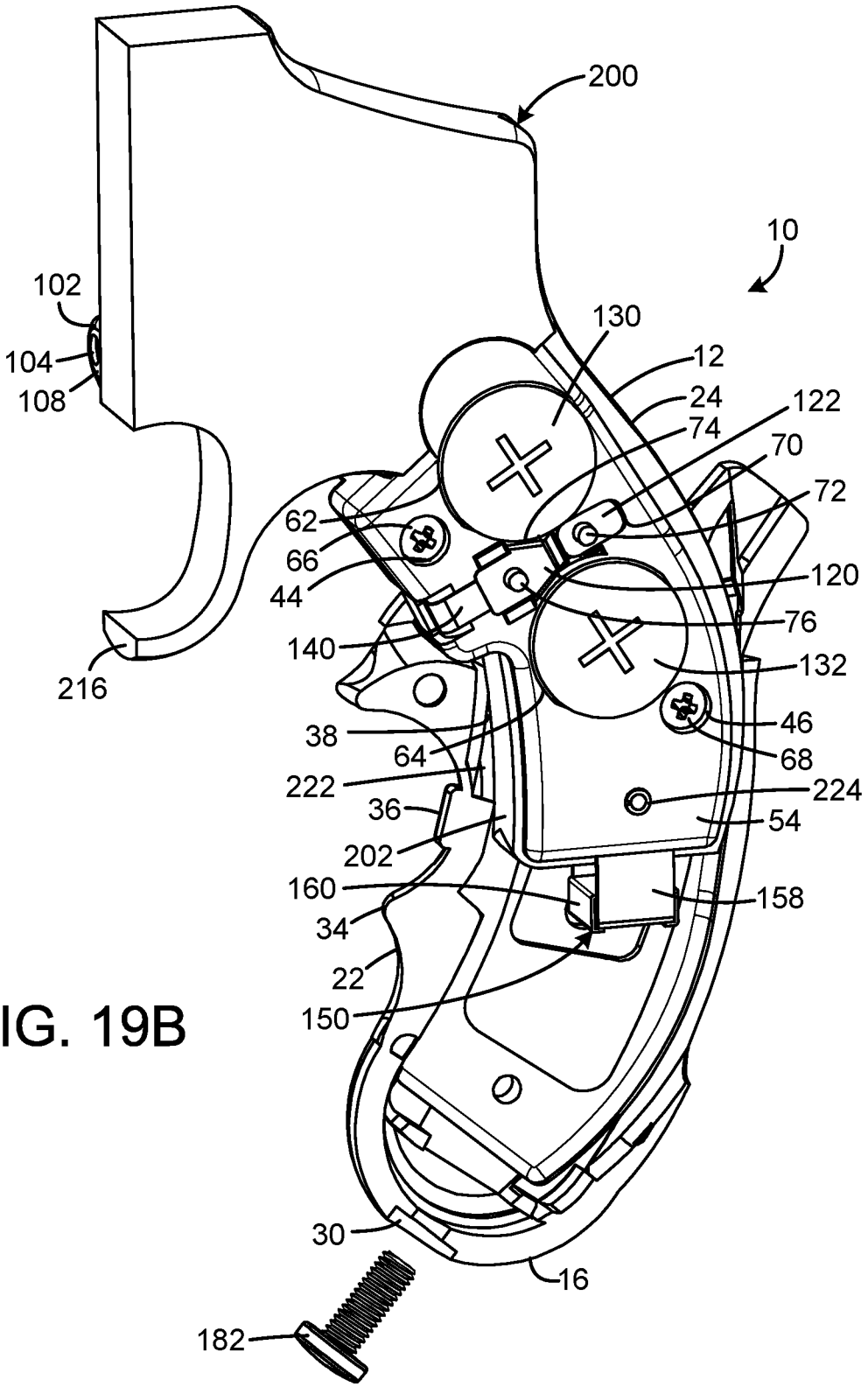
FIG. 19B is a left side sectional view of the firearm handgrip assembly with laser gunsight system of FIG. 1 at the second stage of installation of the exterior skin onto the pistol frame of a Smith & Wesson® J-Frame revolver.
Figure 20:
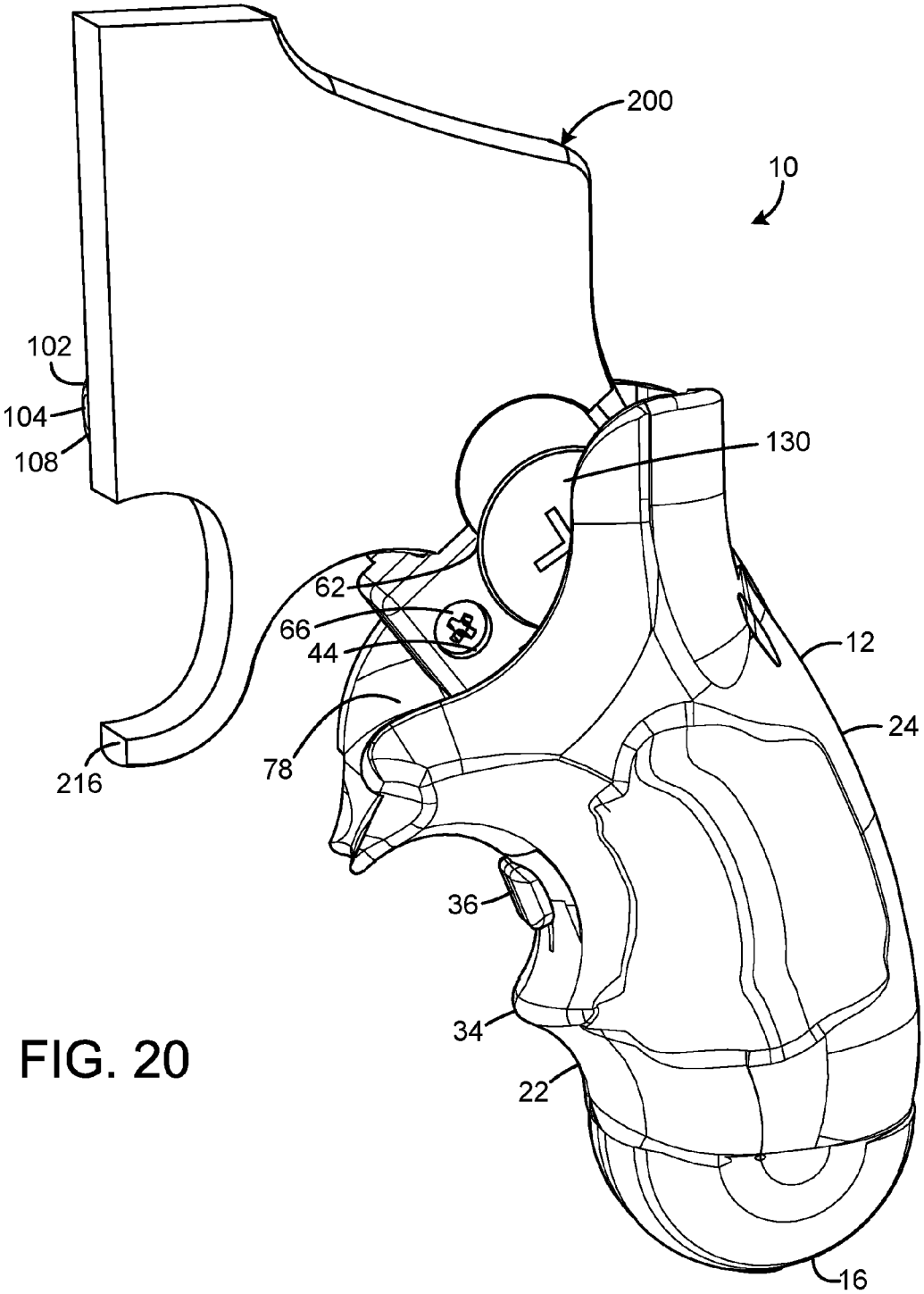
FIG. 20 is a left side view of the firearm handgrip assembly with laser gunsight system of FIG. 1 at the third stage of installation of the exterior skin onto the pistol frame of a Smith & Wesson® J-Frame revolver.

In use, the firearm handgrip assembly with laser gunsight system 10 is installed on the standard factory-supplied handgrip 202 of a pistol with removable grips. To attach the firearm handgrip assembly with laser gunsight system 10, the existing grips are removed from the handgrip by unscrewing the factory-supplied screw(s) from the handgrip. Subsequently, the roll pin 224 is inserted through the aperture 226 in the handgrip and the apertures 162 in the stirrup straps 158 to attach the stirrup clip 150 to the handgrip. Then, the right plate 56 is attached to the right side 208 of the handgrip, the left plate 54 is attached to the left side 210 of the handgrip, and the screws 66, 68 and nuts 80, 82 are used to clamp the handgrip between the left and right plates (the condition shown in FIGS. 15A, 15B, 18A, and 18B.). The lower free end 206 of the handgrip is then initially inserted into an upper central opening 68 in the exterior skin 12 that accesses a curved interior channel defined by the interior surface 38 of the exterior skin (as shown in FIGS. 16A, 16B, 19A, and 19B). After the lower free end is more fully inserted into the upper central opening (shown in FIGS. 17 and 20), the screw 182 is threadedly engaged with the stirrup nut 160 and tightened to secure the exterior skin in the installed position shown in FIGS. 1 and 2.

The firearm handgrip assembly with laser gunsight system 10 is then ready to undergo the sighting-in procedure. While squeezing the activation switch cover 36 to activate the laser diode 106, the user fires a few rounds at a target. After noting where the bullets are striking relative to the laser beam reflection on the target is located, the user adjusts the windage screw 112 and/or the elevation screw 114 until subsequent fired rounds impact where the laser beam reflection on the target is located. The laser diode will remain sighted-in until the left and right plates 54, 56 are loosened or detached from the handgrip 202.

Although the upper and lower batteries 130, 132 will provide sufficient power for the laser diode 106 to illuminate for several hours, the batteries eventually require replacement. Fortunately, both batteries can be replaced without loosening or detaching the left or right plates 54, 56 from the handgrip 202. Instead, the user merely unscrews the screw 182 and slides off exterior skin 12 to expose the upper and lower batteries while the left and right plates remain firmly secured to the handgrip. The spent batteries are removed, new batteries are inserted, and the exterior skin is reattached to the handgrip without any disturbance to the position of the right plate or the laser diode. As a result, both batteries can be replaced without requiring the user to repeat the sighting-in process since no point of aim error can be introduced by the battery change process.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm handgrip assembly with laser gunsight system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while M1911 pistols as described are the most likely contemplated application for the concepts of the present invention, it should be appreciated that the current invention could be used with any firearm grip, including revolvers and rifles such as AR-15s, as well as hand and power tools and other implements with a handgrip.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grip for mounting to a firearm frame comprising:

a first grip frame element adapted for mounting to a first portion of a firearm frame;

the first grip frame element having a first portion including at least one of a battery, a switch, and a controller;

a cover portion of the grip being a tubular elongated body defining an interior channel having an open upper end adapted to closely receive and encompass a first portion of a firearm frame and the first portion of the first grip frame element;

the cover portion having a contoured exterior surface adapted for gripping by a user's hand; and a fastener operably engaging the cover portion to a firearm frame.

2. The grip of claim 1 wherein the firearm frame is a curved butt frame of a revolver.

3. The grip of claim 1 wherein the interior channel of the cover portion is curved.

4. The grip of claim 1 wherein the fastener includes a threaded element connected to a lower end of the firearm frame, and a threaded fastener passing through a fastener aperture defined in the cover portion.

5. The grip of claim 1 including a second grip frame element.

6. The grip of claim 5 wherein the first and second grip frame elements are adapted to mount on opposed major faces of the firearm frame.

7. The grip of claim 6 including an electrical conductor interconnecting the first and second grip frame elements.

8. The grip of claim 7 including a switch operably connected to the electrical conductor.

9. The grip of claim 6 wherein each of the first and second grip frame elements is a planar member.

10. The grip of claim 9 wherein the first and second grip frame elements are parallel to each other.

11. The grip of claim 5 wherein at least one of the first and second grip frame elements includes an illuminator received in an illuminator frame portion, and wherein the cover portion encompasses the first and second grip frame elements except for the illuminator frame portion.

12. The grip of claim 1 wherein the first grip frame element is formed of a rigid material that does not flex during firearm operation, and wherein the cover portion includes an elastomeric surface portion.

13. The grip of claim 1 wherein the cover portion is free of any electrical components.

14. The grip of claim 1 wherein the cover portion encompasses the front and sides of the first portion of the firearm frame.

15. The grip of claim 1 wherein the cover portion includes a flexible portion operably aligned with a switch on the first grip frame element, such that pressure on the flexible portion of the cover operates the switch.

16. The grip of claim 1 wherein the cover portion is connected to the frame by only a single fastener.

17. A grip assembly for mounting to a firearm frame having a frame grip, the grip assembly comprising:

a first grip frame element adapted for mounting to the frame grip;

the first grip frame element having an elongated frame portion having a lower end and an upper end, and including at least one of a battery, a switch, and a controller;

an illuminator connected to the upper end of the elongated frame portion;

a cover portion of the grip defining an interior channel adapted to closely receive the frame grip and the frame portion of the frame element;

the first grip frame element having opposed first and second perimeter edges, the first perimeter edge being convex, and the second perimeter edge being concave; and the interior channel having first and second opposed perimeter edges, the first channel perimeter edge being convex and the second channel perimeter edge being concave.

18. The grip assembly of claim 17 including a second grip frame element including the illuminator.

19. The grip assembly of claim 18 wherein the first and second grip frame elements are adapted to mount on opposed major faces of the firearm frame.

20. The grip assembly of claim 18 including an electrical conductor interconnecting the first and second grip frame elements.

21. The grip assembly of claim 17 wherein the illuminator is outside of the channel such that it projects a beam without blockage by the cover portion of the grip.

22. The grip assembly of claim 17 wherein the cover portion has a contoured exterior surface adapted for gripping by a user's hand.

23. The grip assembly of claim 17 including a fastener operably engaging the cover portion to the firearm frame.

24. A grip assembly for mounting to a firearm frame having a frame grip having opposed first and second sides, the grip assembly comprising:

a first grip frame element adapted for mounting to the first side of the frame grip;

a second grip frame element adapted for mounting to the second side of the frame grip;

each of the first and second grip frame elements including at least one of a battery, a switch, a controller and an illuminator;

an electrical conductor extending between the first and second grip frame elements;

a grip cover element defining a channel adapted to receive the frame grip, and at least major portions of the first and second grip frame elements; and wherein the grip cover element includes a flexible button portion, and the electrical conductor includes a switch registered with the button portion when the grip cover element is installed.

25. A grip for mounting to a firearm frame having a grip portion having opposed major faces and a free end extending away from the frame, the grip comprising:

a first grip frame element adapted for mounting to the grip portion of the firearm frame to overlay at least a portion of one of the major faces;

the first grip frame element having a first portion including at least one of a battery, a switch, and a controller;

a cover portion having a contoured exterior surface adapted for gripping by a user's hand;

the cover portion adapted to overlay the first grip frame element;

a fastener operably engaging the cover portion to a firearm frame; and the fastener adapted for connection to a free end surface.

26. The grip of claim 25 including a connection element adapted for connection to the free end of the frame and defining a threaded aperture adapted for receiving the fastener.

27. The grip of claim 25 wherein the cover portion is an elongated tubular body defining a first open end and having an opposed second end receiving the fastener.

* * * * *